US009505047B2

(12) United States Patent
Yamagata et al.

(10) Patent No.: US 9,505,047 B2
(45) Date of Patent: Nov. 29, 2016

(54) PRESS-FORMING METHOD

(71) Applicant: NIPPON STEEL & SUMITOMO METAL CORPORATION, Tokyo (JP)

(72) Inventors: Mitsuharu Yamagata, Tokyo (JP); Shuji Yamamoto, Tokyo (JP); Yasuhiro Wada, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 0 days.

(21) Appl. No.: 14/653,153

(22) PCT Filed: Dec. 27, 2013

(86) PCT No.: PCT/JP2013/085160
§ 371 (c)(1),
(2) Date: Jun. 17, 2015

(87) PCT Pub. No.: WO2014/109263
PCT Pub. Date: Jul. 17, 2014

(65) Prior Publication Data

US 2015/0336152 A1 Nov. 26, 2015

(30) Foreign Application Priority Data

Jan. 9, 2013 (JP) ..... 2013-001833

(51) Int. Cl.
*B21D 24/00* (2006.01)
*B21D 22/28* (2006.01)

(52) U.S. Cl.
CPC ..... *B21D 24/005* (2013.01); *B21D 22/28* (2013.01)

(58) Field of Classification Search
CPC ..... B21D 24/005; B21D 22/28
See application file for complete search history.

(56) References Cited

U.S. PATENT DOCUMENTS

2008/0299352 A1 12/2008 Matsuda et al.
2013/0061647 A1 3/2013 Matsuda et al.

FOREIGN PATENT DOCUMENTS

JP 2001-47175 A 2/2001
JP 2010-23111 A 2/2010

(Continued)

OTHER PUBLICATIONS

English translation of the International Preliminary Report on Patentability and Written Opinion of the International Searching Authority (Forms PCT/IB/338, PCT/IB/373 and PCT/ISA/237), dated Jul. 23, 2015, for International Application No. PCT/JP2013/085160.

(Continued)

*Primary Examiner* — Teresa M Ekiert
(74) *Attorney, Agent, or Firm* — Birch, Stewart, Kolasch & Birch, LLP

(57) ABSTRACT

A press-forming method includes: a step of forming a first cup-shaped workpiece (B); a step of moving an axial pressing punch (13) relatively to a die (15) to abut on a cup opening end (B21) of a cup sidewall portion (B2), and while constraining the cup opening end (B21), moving a second-stage forming punch (11) relatively to the die (15) to insert the second-stage forming punch (11) into a second die hole portion (155), and pushing a part of the first cup-shaped workpiece into the second die hole portion (155) through a second die shoulder portion (154), to thereby reduce the cup sidewall portion (B2) in diameter and thicken the cup sidewall portion (B2); and a step of, in a state of the constraint of the cup opening end (B21) by the axial pressing punch (13) being released, moving the second-stage forming punch (11) relatively to the die (15) and further pushing the first cup-shaped workpiece deeper in the second die hole portion (155), to thereby form a second cup-shaped workpiece smaller in diameter than the first cup-shaped workpiece.

6 Claims, 21 Drawing Sheets

(56) References Cited

FOREIGN PATENT DOCUMENTS

| | | | |
|---|---|---|---|
| JP | 2010-89139 | A | 4/2010 |
| JP | 2010-214381 | A | 9/2010 |
| JP | 2012-210643 | A | 11/2012 |
| JP | 2012-254483 | A | 12/2012 |
| WO | WO 2013/002363 | A1 | 1/2013 |

OTHER PUBLICATIONS

International Search Report, issued in PCT/JP2013/085160, dated Mar. 25, 2014.

Katoh, "Effect of Opposite Load in Deep Drawing of Thick Blank", Transactions of The Japan Society of Mechanical Engineers (Series C), vol. 59, No. 560, Apr. 1993, pp. 281-286.

Written Opinion of the International Searching Authority, issued in PCT/JP2013/085160, dated Mar. 25, 2014.

PRESS-FORMING METHOD

TECHNICAL FIELD

The present invention relates to a press-forming method of forming a plate-shaped workpiece into a cup shape.

BACKGROUND ART

As a part used for a transmission of a vehicle, or the like, an axisymmetric part having a cup sidewall portion and a cup bottom portion has been known. When general drawing is used in order to obtain a cup-shaped axisymmetric part, normally, the limit of a drawing ratio (drawing ratio=blank diameter/cup outside diameter after forming) becomes 2.1 or so (see Non Patent Literature).

Note that Patent Literature 1 or Patent Literature 2 discloses a thickening and pressing method to suppress occurrence of a crack and the like.

CITATION LIST

Patent Literature

Patent Literature 1: Japanese Laid-open Patent Publication No. 2001-047175

Patent Literature 2: Japanese Laid-open Patent Publication No. 2010-089139

Non Patent Literature

Non Patent Literature 1: Transactions of The Japan Society of Mechanical Engineers (Series C) Vol. 59 No. 560 (1993-4)

SUMMARY OF INVENTION

Technical Problem

When a drawing ratio exceeds 2.1 in general drawing, during forming, deformation concentrates to cause a risk that a cup shoulder portion or a cup sidewall portion whose sheet thickness is reduced largely is fractured.

An object of the present invention is to provide a press-forming method capable of suppressing fracture in a deformation concentrated portion even at the time of forming with a large drawing ratio.

Solution to Problem (1) In order to solve the above-described object, a press-forming method according to the present invention is a press-forming method for a plate-shaped workpiece that uses a second-stage forming punch, a first-stage forming punch disposed along an outer periphery of the second-stage forming punch, an axial pressing punch disposed along an outer periphery of the first-stage forming punch, and a die including: from a leading end side where the first-stage and second-stage forming punches are inserted, a first die shoulder portion that expands outward as it goes to the leading end; a first die hole portion parallel to a central axis; a second die shoulder portion that faces the first-stage forming punch and the axial pressing punch in the central axis direction and expands outward as it goes to the leading end; and a second die hole portion connected to the second die shoulder portion, central axes of all of which are disposed coaxially, the method including: a step S1 of moving the first-stage and second-stage forming punches relatively to the die and inserting the first-stage and second-stage forming punches into the first die hole portion, to thereby push the workpiece into the first die hole portion through the first die shoulder portion to form a first cup-shaped workpiece having a cup bottom portion and a circumferential cup sidewall portion rising from a circumferential edge portion of the cup bottom portion; a step S2 of moving the axial pressing punch relatively to the die to abut on a cup opening end of the cup sidewall portion, and while constraining the cup opening end, moving the second-stage forming punch relatively to the die to insert the second-stage forming punch into the second die hole portion and pushing a part of the first cup-shaped workpiece into the second die hole portion through the second die shoulder portion, to thereby reduce the cup sidewall portion in diameter and thicken the cup sidewall portion; and a step S3 of, in a state of the constraint of the cup opening end by the axial pressing punch being released, moving the second-stage forming punch relatively to the die and further pushing the first cup-shaped workpiece deeper in the second die hole portion, to thereby form a second cup-shaped workpiece smaller in diameter than the first cup-shaped workpiece.

(2) In the press-forming method according to (1), a counter punch disposed to face the second-stage forming punch in the central axis direction is further used and along an outer periphery of the counter punch, the second die hole portion is disposed, the step S2 includes a step S21 of, while constraining the cup opening end by the axial pressing punch and while constraining deformation of the cup sidewall portion on the cup bottom portion side in a sheet thickness direction by the second-stage forming punch and the second die hole portion, bringing the counter punch close to the second-stage forming punch to compress the cup bottom portion in the second die hole portion by the counter punch and the second-stage forming punch, to thereby form a cup shoulder portion connecting the cup bottom portion and the cup sidewall portion into an orthogonal shape and cause a material of the cup bottom portion to flow into the cup shoulder portion to thicken the cup shoulder portion, and in the step S3, while compressing the cup bottom portion, the second-stage forming punch and the counter punch may also be moved deeper in the second die hole portion relatively to the die.

(3) In order to solve the above-described object, a press-forming method according to the present invention is a press-forming method for a plate-shaped workpiece that uses a second-stage forming punch, a first-stage forming punch disposed along an outer periphery of the second-stage forming punch, an axial pressing punch disposed along an outer periphery of the first-stage forming punch, a counter punch disposed to face the second-stage forming punch in a central axis direction, and a die including: from a leading end side where the first-stage and second-stage forming punches are inserted, a first die shoulder portion that expands outward as it goes to the leading end; a first die hole portion parallel to a central axis; a second die shoulder portion that faces the first-stage forming punch and the axial pressing punch in the central axis direction and expands outward as it goes to the leading end; and a second die hole portion disposed along an outer periphery of the counter punch, central axes of all of which are disposed coaxially, the method including: a step SA1 of moving the first-stage and second-stage forming punches relatively to the die and inserting the first-stage and second-stage forming punches into the first die hole portion, to thereby push the workpiece into the first die hole portion through the first die shoulder portion to form a first cup-shaped workpiece having a cup bottom portion and a circumferential cup sidewall portion rising from a circumferential edge portion of the cup bottom portion; a step SA2 of bringing the axial pressing punch to abut on a cup opening end of the cup sidewall portion, and while constraining the cup opening end, moving the axial pressing punch relatively to the die and pushing a part of the first cup-shaped workpiece into the second die hole portion through the second die shoulder portion, to thereby reduce the cup sidewall portion in diameter and thicken the cup sidewall portion; a step SA3 of, while constraining the cup opening end by the axial pressing punch, bringing the second-stage forming punch and the counter punch close to each other, compressing the cup bottom portion in the second die hole portion by the second-stage forming punch and the counter punch to form the flat cup bottom portion, and causing a material of the cup bottom portion to flow into a cup shoulder portion connecting the cup bottom portion and the cup sidewall portion to thicken the cup shoulder portion; and a step SA4 of moving the second-stage forming punch relatively to the die and further pushing the first cup-shaped workpiece deeper in the second die hole portion, to thereby form a second cup-shaped workpiece smaller in diameter than the first cup-shaped workpiece.

(4) In the press-forming method according to (3), in the step SA4, the second cup-shaped workpiece is pushed into the second die hole portion until the cup opening end is positioned in the second die hole portion, and the press-forming method may also further include a step SA5 of, while compressing the cup bottom portion by the second-stage forming punch and the counter punch and while constraining deformation of the cup sidewall portion on the cup bottom portion side in a sheet thickness direction by the second-stage forming punch and the second die hole portion, moving the second-stage forming punch and the counter punch relatively in a direction to come close to the first-stage forming punch to cause the cup opening end to butt against the first-stage forming punch, to thereby form the cup shoulder portion into an orthogonal shape.

(5) In the press-forming method according to any one of (1) to (4), in the steps S3 and SA4, the first cup-shaped workpiece may also be pushed into the second die hole portion until the cup opening end is positioned on the second die shoulder portion, to thereby form the second cup-shaped workpiece provided with an expanded opening portion that expands outward as it goes to the cup opening end side.

(6) In order to solve the above-described object, a press-formed product according to the present invention is characterized in that it is formed by the press-forming method according to any one of (1) to (5).

Advantageous Effects of Invention

According to the present invention, it is possible to provide a press-forming method capable of suppressing fracture in a deformation concentrated portion even when a large drawing ratio is taken.

DESCRIPTION OF EMBODIMENTS

Hereinafter, each embodiment of the present invention will be explained with reference to the drawings.

First Embodiment

Figure 1:
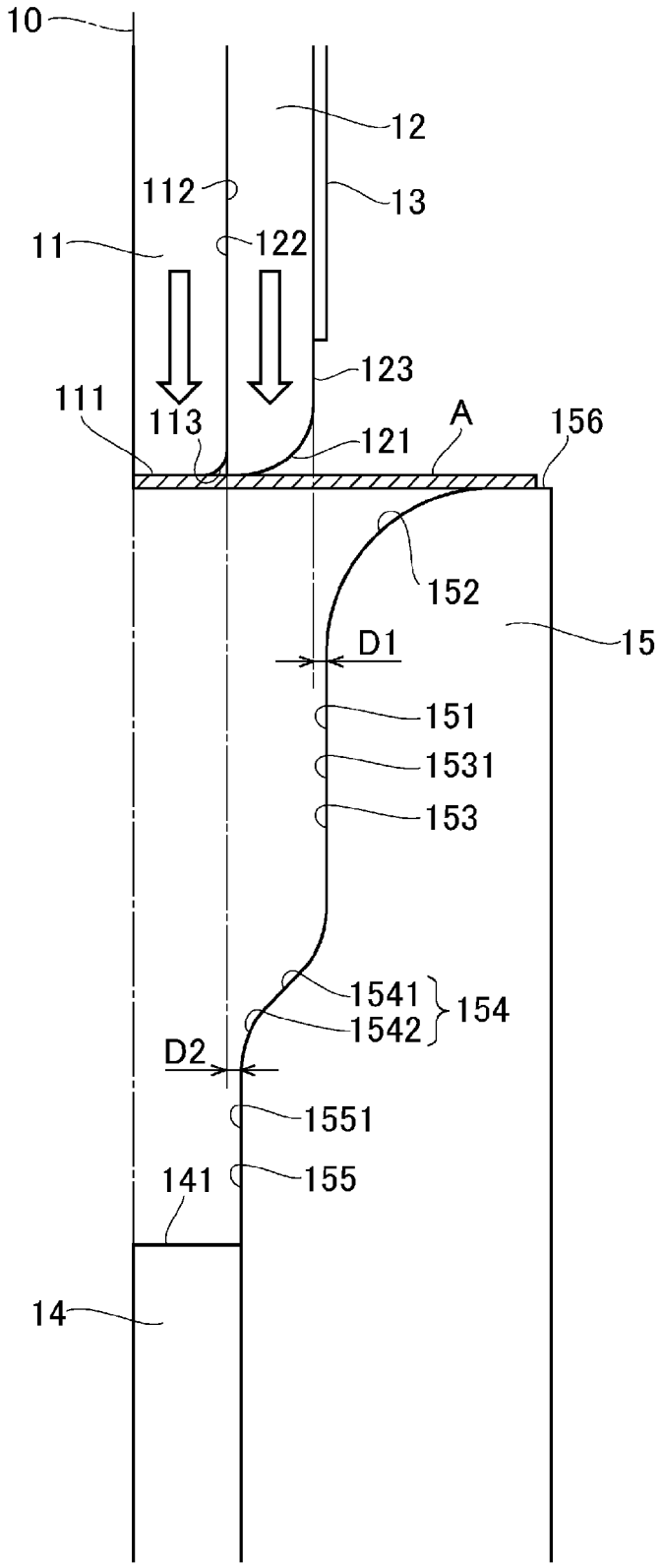
FIG. 1 is a schematic constitution view of a press-forming apparatus of a first embodiment in the present invention.

FIG. 1 is a schematic constitution view of a press forming apparatus of a first embodiment. In the drawings of FIG. 1 and after, the cross section of the press forming apparatus including the central axis is axisymmetric across the central axis. In order to simplify the drawings, only the cross section on one side across the central axis of the press forming apparatus is illustrated.

The press forming apparatus performs press forming in which a disk-shaped (plate-shaped) workpiece A is formed into a first cup-shaped workpiece, and then while thickening a cup sidewall portion, the cup-shaped workpiece is reduced in diameter and a second cup-shaped workpiece smaller in diameter than the first cup-shaped workpiece is formed. The press forming apparatus performs press forming using a press mold including: a second-stage forming punch 11; a first-stage forming punch 12; an axial pressing punch 13; a counter punch 14; and a die 15. These second-stage forming punch 11 to die 15 each being a component of the mold are axisymmetrically disposed with respect to a central axis 10 of the press forming apparatus, and can be raised and lowered independently. Note that press forming similar to that in the case of raising and lowering the respective punches of the second-stage forming punch 11 to the counter punch 14 and the die 15 independently is also possible by fixing the die 15 and moving the second-stage forming punch 11, the first-stage forming punch 12, the axial pressing punch 13, and the counter punch 14 relatively to the die 15, for example.

The second-stage forming punch 11 has a column shape, and has a flat leading end surface 111 extending in a direction perpendicular to the central axis 10 formed on a leading end surface thereof facing the counter punch 14. At a leading end corner portion of the second-stage forming punch 11, an R-shaped second punch shoulder portion 113 is formed. In other words, the second punch shoulder portion 113 is formed at a position connecting a peripheral edge portion of the flat leading end surface 111 and a lower end portion of an outer peripheral surface 112 of the second-stage forming punch 11.

The first-stage forming punch 12 has a cylindrical hollow shape and is disposed along the outer periphery of the second-stage forming punch 11. At a leading end portion of the first-stage forming punch 12, an R-shaped first punch shoulder portion 121 is formed. In this embodiment, the first punch shoulder portion 121 is formed at a position connecting, of the first-stage forming punch 12, a lower end portion of an inner peripheral surface 122 parallel to the central axis 10 and a lower end portion of an outer peripheral surface 123 parallel to the central axis 10. Here, when the explanation is made with reference to FIG. 20 to be described later, an abutting surface of the first punch shoulder portion 121 to abut on a cup opening end C21 is preferably formed to extend in a radial direction perpendicular to the central axis 10. This makes it possible to increase an abutting area of the first punch shoulder portion 121 and the cup opening end C21.

Figure 2:
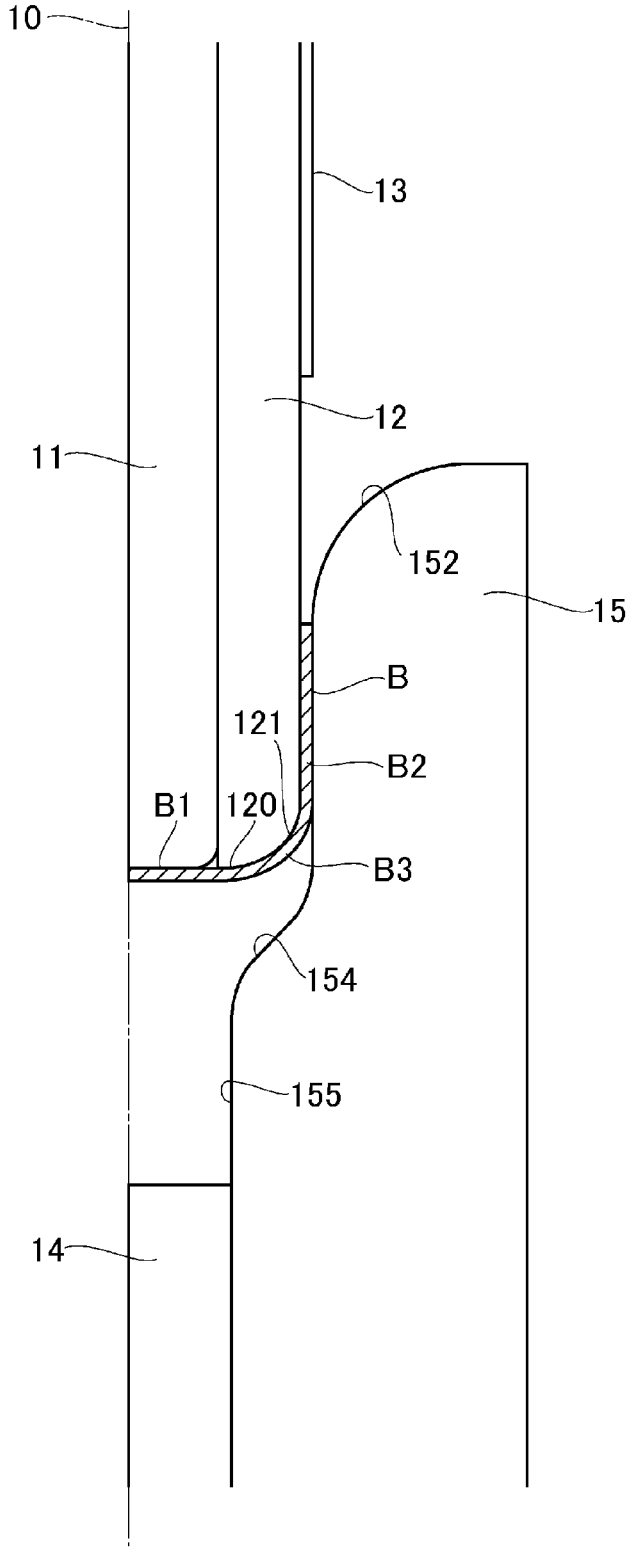
FIG. 2 is a view illustrating a modified example of a first-stage forming punch in the present invention.

However, when the abutting surface of the first punch shoulder portion 121 becomes too long as illustrated in FIG. 2 (namely, a flat leading end surface 120 is formed), a cup shoulder portion B3 becomes small, and when a cup-shaped workpiece B is further drawn by a later-described second die shoulder portion 154, a force to be given to a cup bottom portion B1 and the cup shoulder portion B3 has to be increased. In contrast to this, as illustrated in FIG. 1, when the flat leading end surface 120 does not exist and the first punch shoulder portion 121 is formed into a shape extending from the lower end portion of the inner peripheral surface 122, when the cup-shaped workpiece B is formed by a later-described first die shoulder portion 152, the cup shoulder portion B3 can be formed largely. Therefore, when the cup-shaped workpiece B is further drawn by the later-described second die shoulder portion 154, only a small force, which is given to the cup bottom portion B1 and the cup shoulder portion B3, is required and drawing can be well performed.

With reference to FIG. 1 again, the axial pressing punch 13 has a cylindrical hollow shape, and is disposed along the outer periphery of the first-stage forming punch 12.

The counter punch 14 has a column shape, and is disposed to face the second-stage forming punch 11 in the direction of the central axis 10. At a facing surface of the counter punch 14 facing the second-stage forming punch 11, a flat leading end surface 141 extending in a direction perpendicular to the central axis 10 is formed.

The die 15 has a circular ring shape and has an insertion hole portion 151 extending in the axial direction. The insertion hole portion 151 includes: the first die shoulder portion 152; a first die hole portion 153; the second die shoulder portion 154; and a second die hole portion 155 in the order from the leading end side where the first-stage and second-stage forming punches 12 and 11 are inserted (the upper side in FIG. 1). The first die shoulder portion 152 expands outward as it goes to the leading end of the insertion hole portion 151. The first die hole portion 153 extends parallel to the central axis 10 and has an upper end portion thereof connected to a lower end portion of the first die shoulder portion 152. A distance D1 in the radial direction between an inner peripheral surface 1531 of the first die hole portion 153 and the outer peripheral surface 123 of the first-stage forming punch 12 (namely the radius difference) results in a size similar to the thickness of the disk-shaped workpiece A (including uncertainties).

The second die shoulder portion 154 is disposed to face the first-stage forming punch 12 and the axial pressing punch 11 in the direction of the central axis 10, expands outward as it goes to the leading end (upward), and has an upper end portion thereof connected to a lower end portion of the first die hole portion 153. The second die shoulder portion 154 has a tapered surface, and includes: a draw portion 1541 with an upper end portion thereof connected to the lower end portion of the first die hole portion 153; and an R-shaped portion 1542 connecting the draw portion 1541 and the second die hole portion 155.

The second die hole portion 155 extends parallel to the central axis 10, and has an upper end portion thereof connected to a lower end portion of the second die shoulder portion 154. The second die hole portion 155 is disposed along the outer periphery of the counter punch 14. A distance D2 in the radial direction between an inner peripheral surface 1551 of the second die hole portion 155 and the outer peripheral surface 112 of the second-stage forming punch 11 is slightly larger than the thickness of the disk-shaped workpiece A. An upper end surface 156 of the die 15 has a circular ring shape in a planar view, and is a flat surface parallel to a direction perpendicular to the central axis 10.

Figure 3:
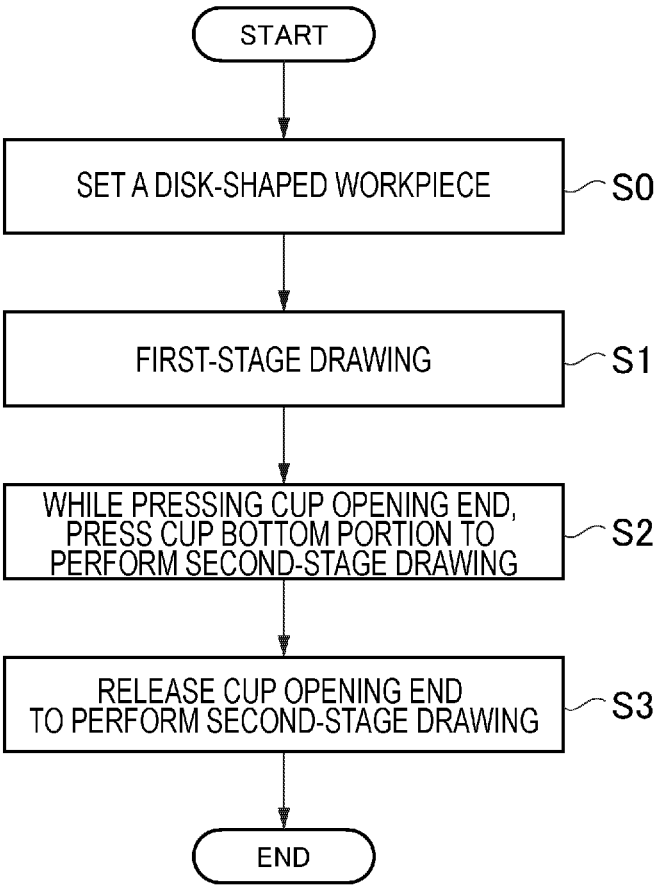
FIG. 3 is a flowchart used for explaining a press-forming method in the present invention.
Figure 4:
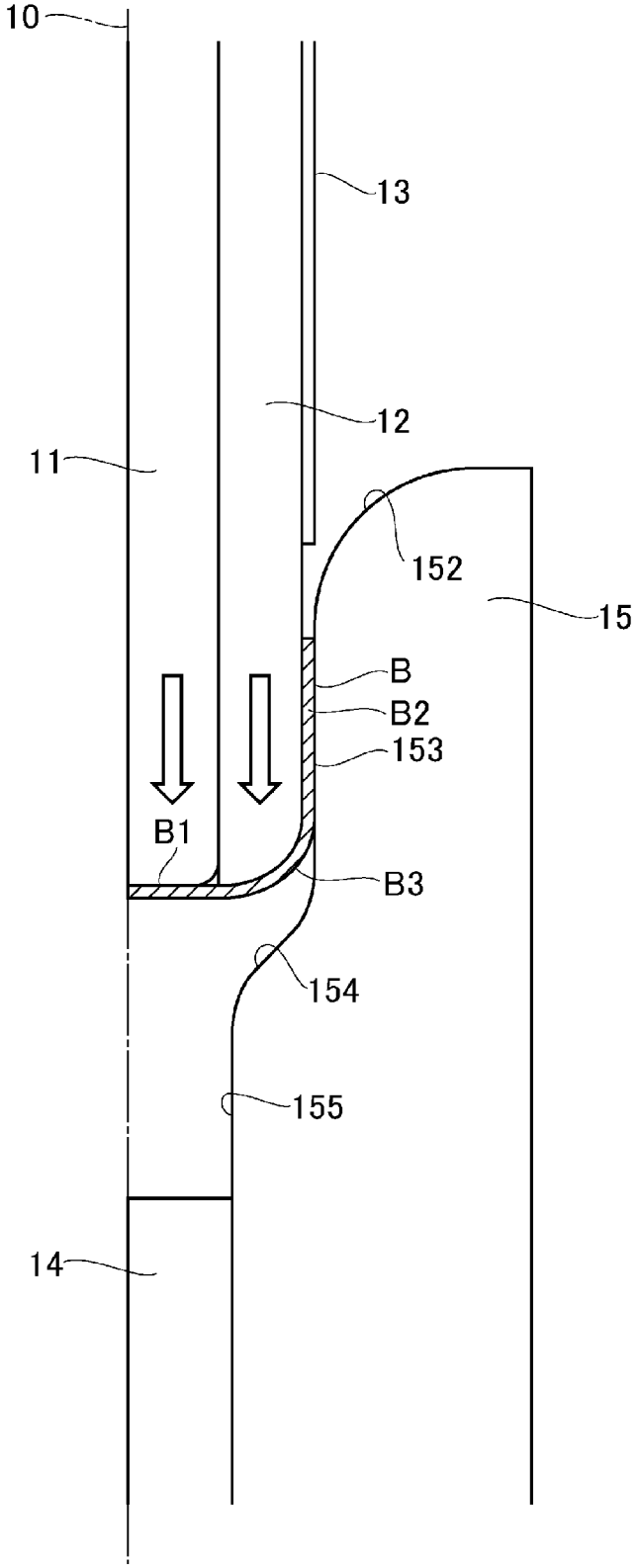
FIG. 4 is a view illustrating a step of first-stage drawing in the present invention.

FIG. 3 is a flowchart used for explaining a forming operation (press-forming method) of the press-forming apparatus. Hereinafter, the forming operation of the press-forming apparatus will be explained. With reference to FIG. 1, the disk-shaped workpiece A is first set on the die 15 (step S0). Subsequently, as illustrated in FIG. 4, the press-forming apparatus integrally lowers the first-stage and second-stage forming punches 12 and 11 and inserts them into the first die hole portion 153 so that their respective lower ends are brought to the same position in the direction of the central axis 10, to thereby push the disk-shaped workpiece A into the first die hole portion 153 through the first die shoulder portion 152.

Thereby, the press-forming apparatus forms the disk-shaped workpiece A into the first cup-shaped workpiece B (step S1). The first cup-shaped workpiece B includes: the cup bottom portion B1; a circumferential cup sidewall portion B2 rising from a circumferential edge portion of the cup bottom portion B1; and the R-shaped cup shoulder portion B3 connecting the cup sidewall portion B2 and the cup bottom portion B1.

Figure 5:
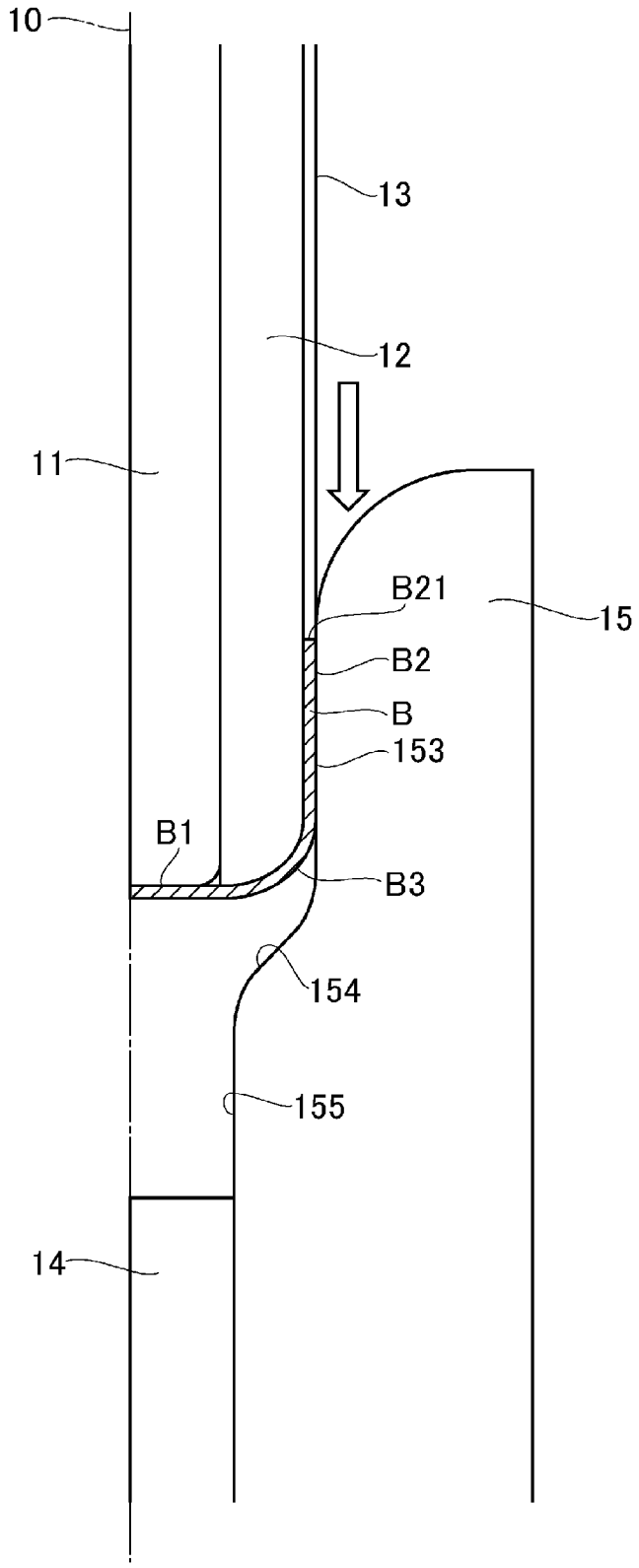
FIG. 5 is a view illustrating a step of second-stage drawing to be performed while pressing a cup opening end in the present invention.
Figure 6:
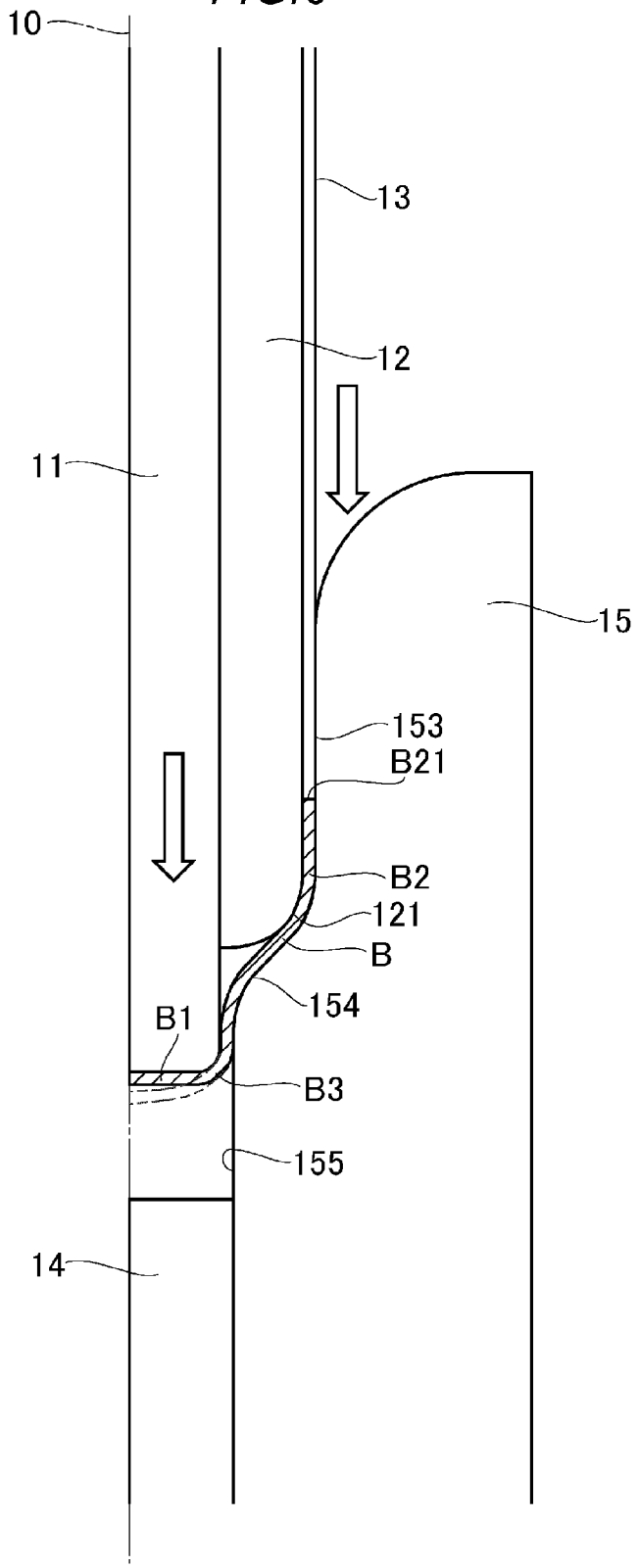
FIG. 6 is a view illustrating how a cup sidewall portion is thickened in the second-stage drawing in the present invention.

Subsequently, as illustrated in FIG. 5, the press-forming apparatus lowers the axial pressing punch 13 to abut on the cup opening end B21 of the cup sidewall portion B2, to thereby constrain rising of the cup opening end B21. Subsequently, as illustrated in FIG. 6, the press-forming apparatus further lowers the second-stage forming punch 11 to insert it into the second die hole portion 155, to thereby push the first cup-shaped workpiece B into the second die hole portion 155 through the second die shoulder portion 154 (step S2). On this occasion, the press-forming apparatus lowers the second-stage forming punch 11 and lowers the axial pressing punch 13 simultaneously, to thereby perform the step S2 while suppressing extension of the cup opening end B21 in a direction parallel to the direction of the central axis 10.

On this occasion, the press-forming apparatus reduces the cup sidewall portion B2 of the first cup-shaped workpiece B in diameter by the second die shoulder portion 154 while constraining the cup opening end B21, so that it is possible to promote thickening of the cup sidewall portion B2 on the second die shoulder portion 154. Further, the press-forming apparatus draws the cup sidewall portion B2 while constraining the cup opening end B21, so that it is possible to suppress variations in position of the cup opening end B21 (edge) in the direction of the central axis 10. Incidentally, when such variations in position exist, the cup opening end B21 is deformed unevenly, for example, wavily or the like, but by the constraint of the cup opening end B21 by the axial pressing punch 13, evenness of the cup opening end B21 can be ensured.

Figure 7:
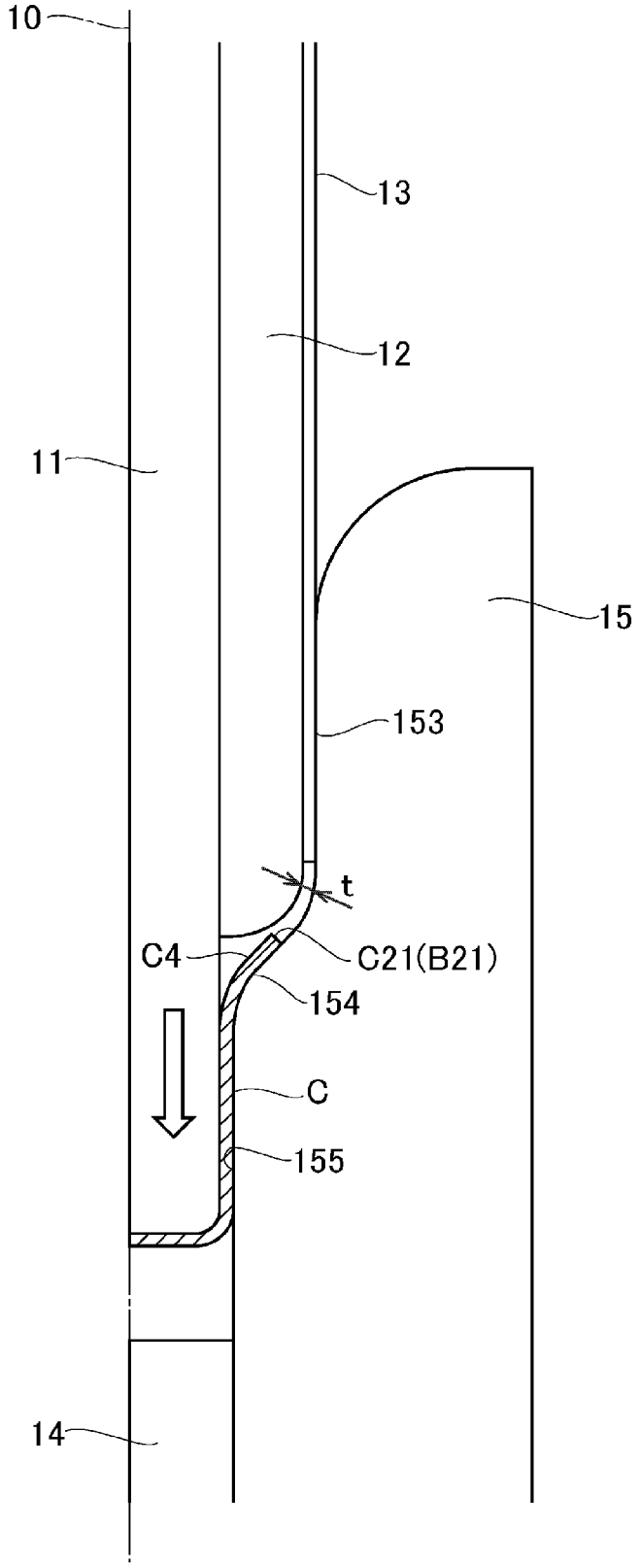
FIG. 7 is a view illustrating a second cup-shaped workpiece that has completed being formed with an expanded opening portion provided therewith in the present invention.

Incidentally, during drawing performed by the lowering of the second-stage forming punch 11, the press-forming apparatus lowers the first-stage forming punch 12 down to the position where the first punch shoulder portion 121 can smoothly guide the cup sidewall portion B2 to move downward at a portion extending from the first die hole portion 153 to the second die shoulder portion 154. That is, as illustrated in FIG. 7, the press-forming apparatus lowers the first-stage forming punch 12 down to the position where a space substantially equal to a sheet thickness t of the first cup-shaped workpiece B is formed between the first punch shoulder portion 121 and the portion extending from the first die hole portion 153 to the second die shoulder portion 154. Further, the axial pressing punch 13 is lowered down to the lowermost position in the vicinity of a boundary line between the first die hole portion 153 and the second die shoulder portion 154, and keeps constraining the cup opening end B21 at the most when the second-stage forming punch 11 is lowered (see FIG. 7).

Figure 8:
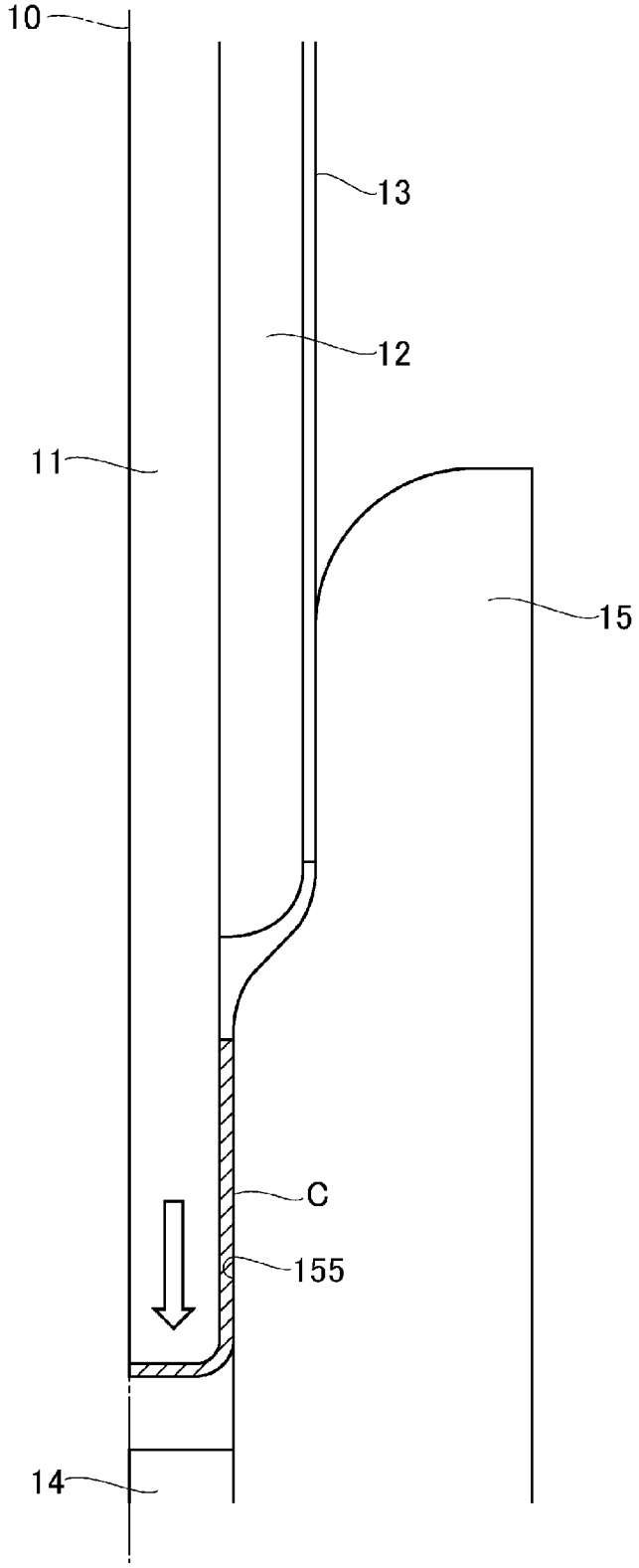
FIG. 8 is a view illustrating the second cup-shaped workpiece that has completed being formed without an expanded opening portion provided therewith in the present invention.

Subsequently, the press-forming apparatus, as illustrated in FIG. 7, lowers the second-stage forming punch 11 in a state where lowering of the axial pressing punch 13 is stopped in the vicinity of the boundary line between the first die hole portion 153 and the second die shoulder portion 154, namely in a state where the constraint of the cup opening end B21 by the axial pressing punch 13 is released. Thereby, the first cup-shaped workpiece B is further pushed deeper in the second die hole portion 155, and thereby a second cup-shaped workpiece C smaller in diameter than the first cup-shaped workpiece B is formed as illustrated in FIG. 8 (step S3).

Incidentally, the press-forming apparatus, as illustrated in FIG. 7, can also stop pushing the first cup-shaped workpiece B into the second die hole portion 155 at the position where the cup opening end B21 is positioned on the second die shoulder portion 154. Thereby, the first cup-shaped workpiece B may also be formed into the second cup-shaped workpiece C provided with an expanded opening portion C4 that expands outward as it goes to the cup opening end C21 side.

In this embodiment as above, two-stage drawing in which the disk-shaped workpiece A is drawn into the first cup-shaped workpiece B and then the first cup-shaped workpiece B is further drawn is performed. Particularly, at the time of the second-stage drawing of the first cup-shaped workpiece B, while constraining deformation of the cup opening end B21 by the axial pressing punch 13, the drawing is performed. Therefore, it is possible to promote thickening of the cup sidewall portion B2 at the time of the second-stage drawing of the first cup-shaped workpiece B and to suppress cracking of the cup sidewall portion B2 at the time of the drawing. Thus, in this embodiment, even when a drawing ratio (blank diameter/cup outside diameter after forming) is set to be large, which is not less than 2.1 nor more than 4.0, the disk-shaped workpiece A can be well drawn into the second cup-shaped workpiece C.

Second Embodiment

Figure 9:
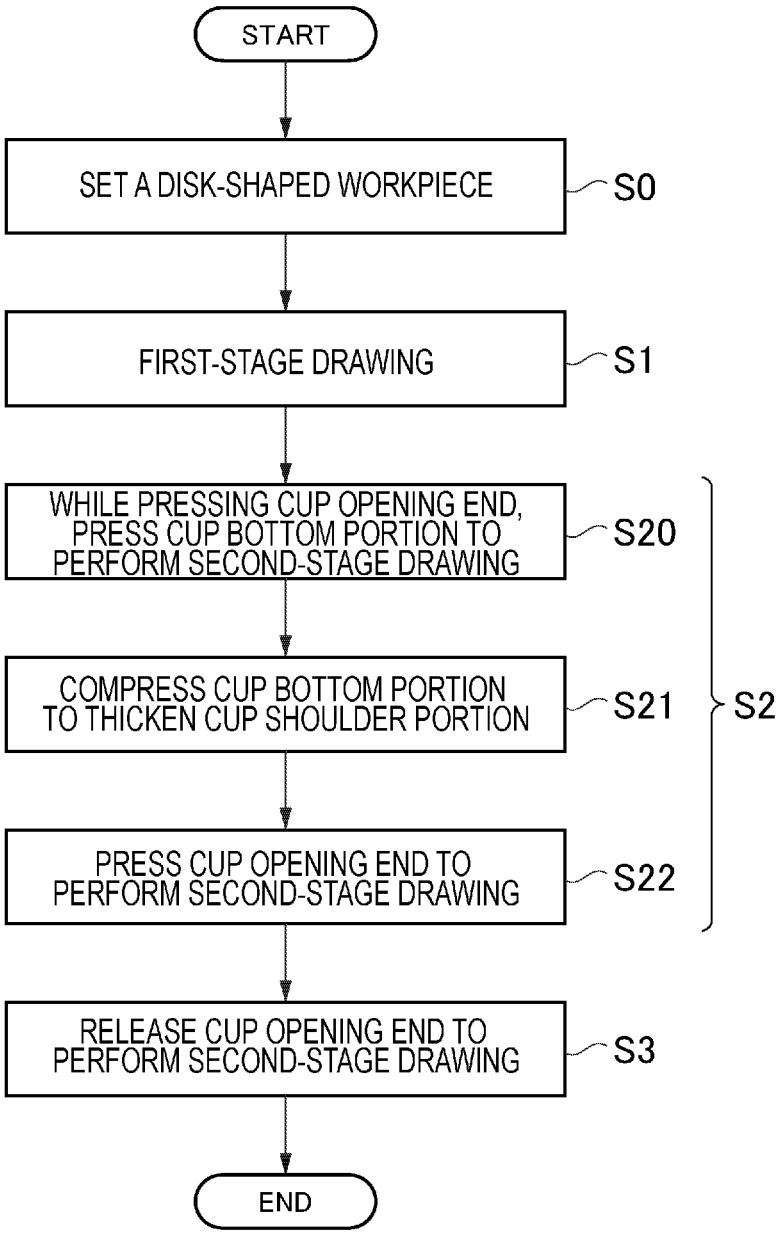
FIG. 9 is a flowchart used for explaining a press-forming method of a second embodiment in the present invention.
Figure 10:
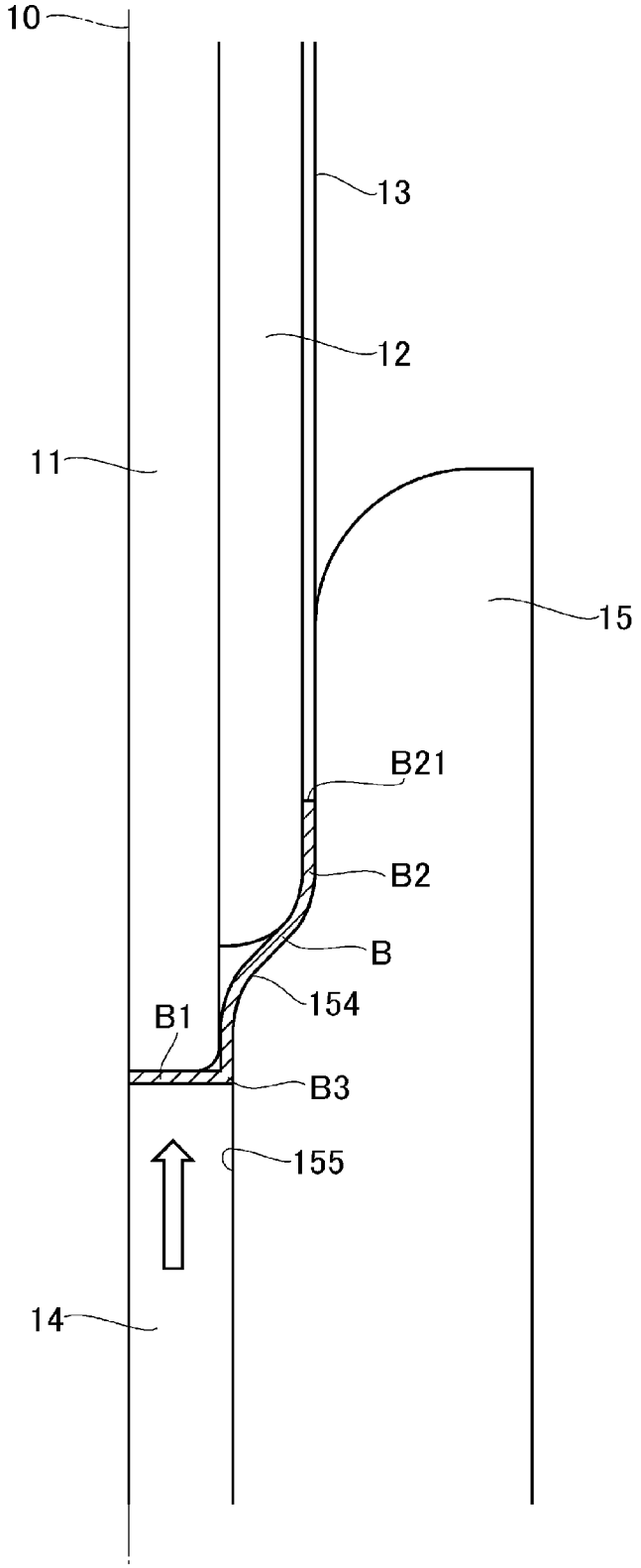
FIG. 10 is a view illustrating a step of compressing a cup bottom portion in the present invention.

FIG. 9 is a flowchart used for explaining a press-forming method in this embodiment, and FIG. 10 is a view illustrating a step S21 of compressing the cup bottom portion B1 to be performed in the middle of the step S2 of drawing the first cup-shaped workpiece B.

The press-forming apparatus in this embodiment also performs the steps S0 and S1 of forming the disk-shaped workpiece A into the first cup-shaped workpiece B, and then performs the step S2 of drawing the first cup-shaped workpiece B while constraining the cup opening end B21 by the axial pressing punch 13, similarly to the first embodiment.

The press-forming apparatus first performs a step S20 of drawing the first cup-shaped workpiece B while constraining the cup opening end B21 by the axial pressing punch 13 in the step S2. In this step S20, the cup opening end B21 is brought into a state of being constrained by the axial pressing punch 13 and deformation of the cup sidewall portion B2 on the cup bottom portion B1 side in a sheet thickness direction is brought into a state of being constrained by the second-stage forming punch 11 and the second die hole portion 155 as referred in FIG. 6. In this step S20, as in an example illustrated by a two-dot chain line in an abbreviated manner in FIG. 6, the center portion of the cup bottom portion B1 is sometimes curved downward from the second-stage forming punch 11, to thereby cause unevenness in the cup bottom portion B1.

Thus, the press-forming apparatus, as illustrated in FIG. 10, brings the counter punch 14 close to the second-stage forming punch 11 to compress the cup bottom portion B1 in the second die hole portion 155 by the counter punch 14 and the second-stage forming punch 11, to thereby correct the cup bottom portion B1 to be flat. Further, the press-forming apparatus compresses the cup bottom portion B1 while constraining deformation of the cup sidewall portion B2 on the cup bottom portion B1 side in the sheet thickness direction, to thereby form the cup shoulder portion B3 into an orthogonal shape. Further, the press-forming apparatus corrects the cup bottom portion B1 to be flat, to thereby cause a redundant material derived from the cup bottom portion B1 to flow into the cup shoulder portion B3, and thereby the cup shoulder portion B3 is thickened (step S21).

Figure 11:
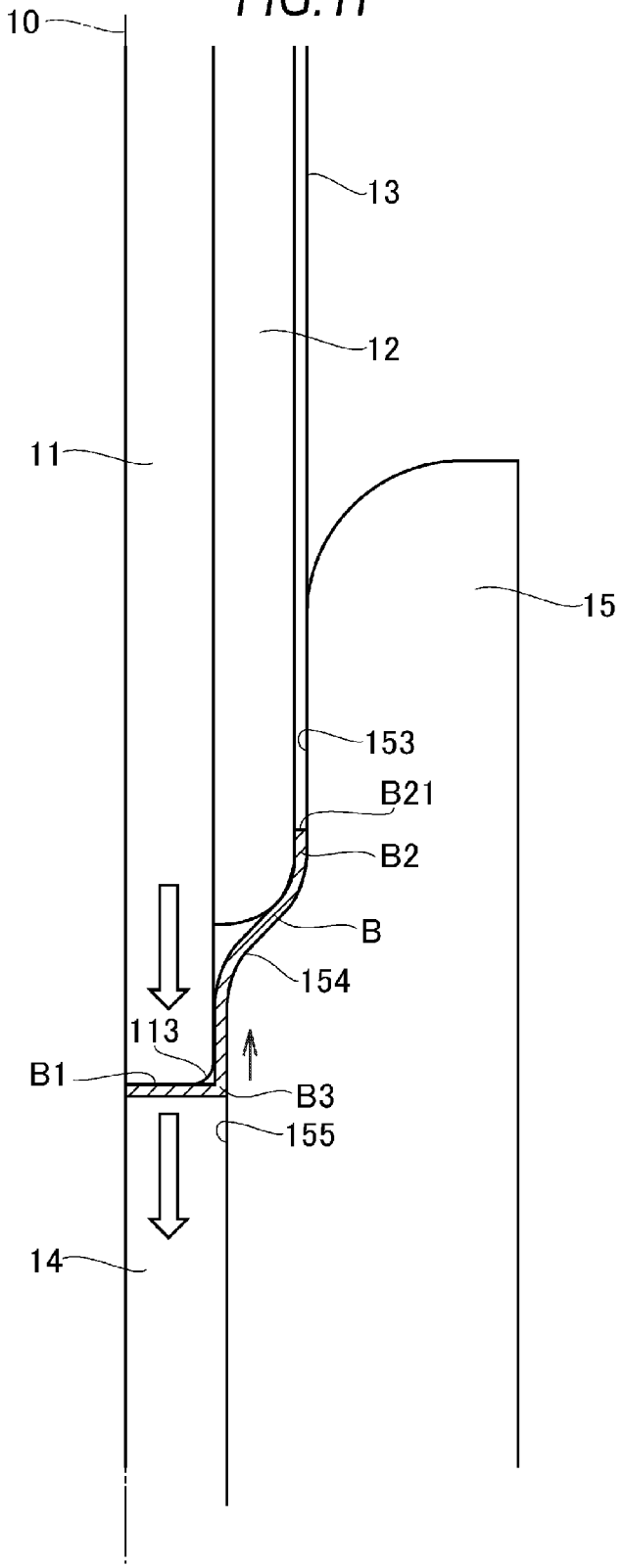
FIG. 11 is a view illustrating a step of drawing to be performed while compressing the cup bottom portion in the present invention.

Subsequently, the press-forming apparatus, as illustrated in FIG. 11, lowers the axial pressing punch 13, and while constraining the cup opening end B21, lowers the second-stage forming punch 11 and the counter punch 14 while compressing the cup bottom portion B1, to thereby draw the first cup-shaped workpiece B (step S22).

Figure 12:
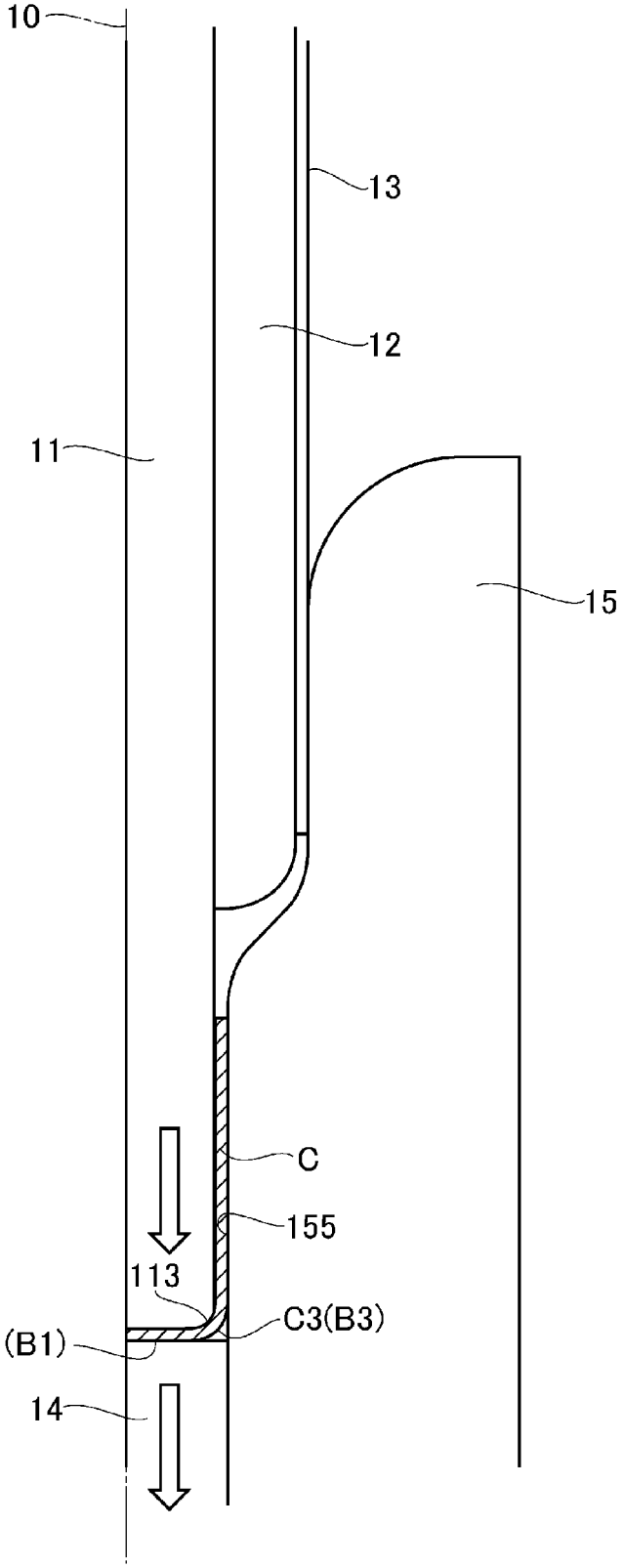
FIG. 12 is a view illustrating the second cup-shaped workpiece that has completed being formed in the present invention.

Then, the press-forming apparatus lowers the axial pressing punch 13 down to the vicinity of the boundary line between the first die hole portion 153 and the second die shoulder portion 154, to then release the constraint of the cup opening end B21 by the axial pressing punch 13. In this released state, the press-forming apparatus, as illustrated in FIG. 12, lowers the second-stage forming punch 11 and the counter punch 14 while compressing the cup bottom portion B1, to thereby form the second cup-shaped workpiece C (step S3).

Here, in the steps S22 and S3, when the first cup-shaped workpiece B is pushed into the second die hole portion 155, as referred in FIG. 11, the cup sidewall portion B2 is drawn into a space between the second-stage forming punch 11 and the second die hole portion 155, and thereby a tensile load in an up and down direction is applied. Therefore, the orthogonal-shaped cup shoulder portion B3 is pulled upward (see an up-arrow in FIG. 11), to be formed into an R shape in close contact with the second punch shoulder portion 113 of the second-stage forming punch 11 as referred in FIG. 12, but in the second cup-shaped workpiece C, the effect of thickening a cup shoulder portion C3 remains.

Incidentally, in the step S3, the second-stage forming punch 11 and the counter punch 14 are lowered while compressing the cup bottom portion B1, to thereby push the first cup-shaped workpiece B deeper in the second die hole portion 155. This embodiment is not limited to this, and by pressing only the second-stage forming punch 11, the first cup-shaped workpiece B may also be pushed deeper in the second die hole portion 155.

In this embodiment, after the compression of the cup bottom portion B1, the axial pressing punch 13 is lowered again to draw the first cup-shaped workpiece B, but it is also possible to, after the compression of the cup bottom portion B1, stop lowering of the axial pressing punch 13 and draw the first cup-shaped workpiece B in a state of constraint of the cup opening end B21 being released (the step S22 is unnecessary). Even when the above is applied, at the stage prior to compression, drawing is performed while constraining the cup opening end B21, so that it is possible to maintain the effect of suppressing formed unevenness of the cup opening end B21 and the effect of promoting thickening of the cup sidewall portion B2.

Here, when normal drawing is performed conventionally, a cup shoulder portion abutting on a shoulder R portion of a drawing punch is thinned, and thus as measures against this, there are known techniques of Patent Literature 3 (Japanese Laid-open Patent Publication No. 08-141662) and Patent Literature 4 (Japanese Laid-open Patent Publication No. 2007-289989).

In Patent Literature 3, drawing is first performed by an apparatus for drawing, and a workpiece is formed into a cup shape. Next, in Patent Literature 3, by an apparatus for coining, a cup bottom portion of the cup-shaped workpiece is subjected to coining, to thereby cause a material of the cup bottom portion to flow into a cup shoulder portion that is thinned by drawing to thicken the cup shoulder portion.

In Patent Literature 4, a punch is inserted into a cup-shaped workpiece to constrain an inner peripheral surface of a cup sidewall portion, and then an outer peripheral surface of the cup sidewall portion is subjected to ironing from a cup opening portion side to a cup bottom portion side by a roller, to thereby thicken a cup shoulder portion.

However, in Patent Literature 3, since the cup bottom portion is subjected to coining, there is a problem that a part of the cup bottom portion is thinned and the cup bottom portion loses flatness, and in Patent Literature 4, since the cup sidewall portion is subjected to ironing, there is a problem that the cup sidewall portion is thinned. Further, since Patent Literatures 3 and 4 are also ones in which a workpiece is formed into a cup-shaped workpiece and then a cup shoulder portion is thickened, there is a problem that fracture in the cup shoulder portion and/or the cup sidewall portion caused when the workpiece is drawn at a drawing ratio of 2.1 or more cannot be suppressed.

As measures against such problems, in this embodiment, at the time of drawing of the first cup-shaped workpiece B, deformation of the cup opening end B21 is constrained by the axial pressing punch 13, and thus thickening of the cup sidewall portion B2 can be promoted, and even when the drawing ratio is set to be large, which is not less than 2.1 nor more than 4.0, forming can be well performed. Further, at the time of reduction in diameter, thickening of the cup sidewall portion B2 can be promoted, so that thinning of the cup sidewall portion B2 can also be prevented. Further, in this embodiment, the cup bottom portion B1 is compressed, and thereby the cup bottom portion B1 can be shape-corrected to be flat, and by the compression of the cup bottom portion B1, the cup shoulder portion B3 can be thickened. In this embodiment, such respective effects can be achieved simultaneously.

Third Embodiment

Figure 13:
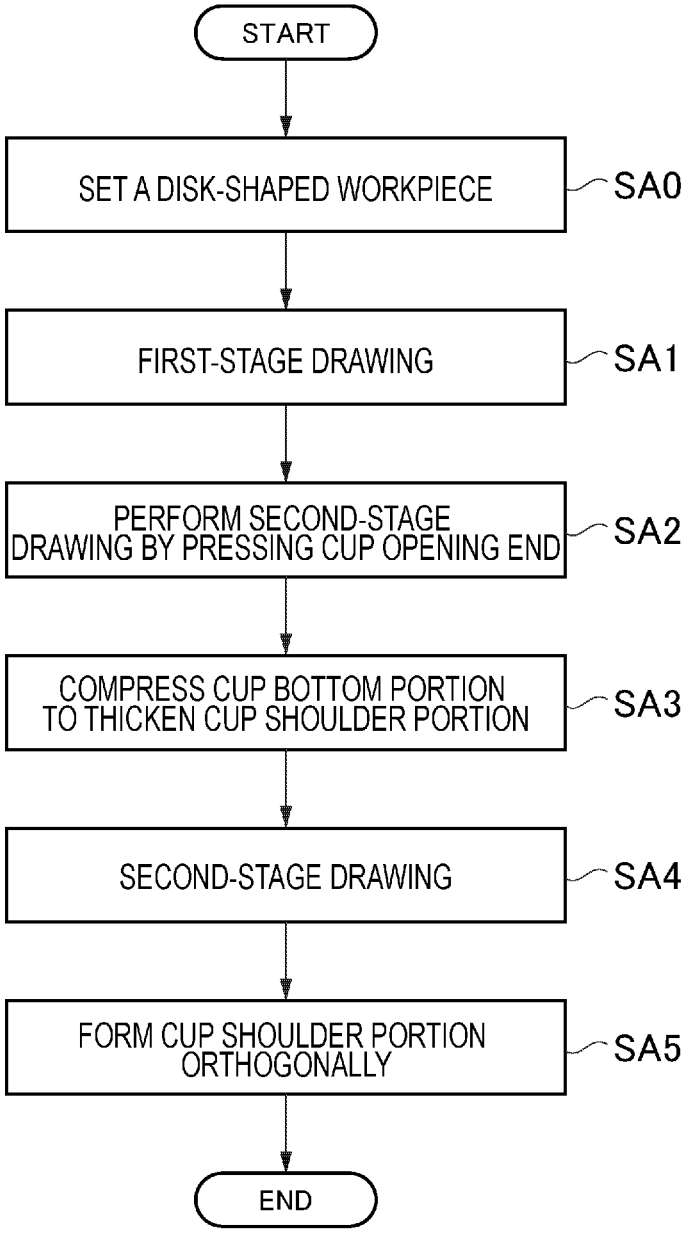
FIG. 13 is a flowchart used for explaining a press-forming method of a third embodiment in the present invention.
Figure 14:
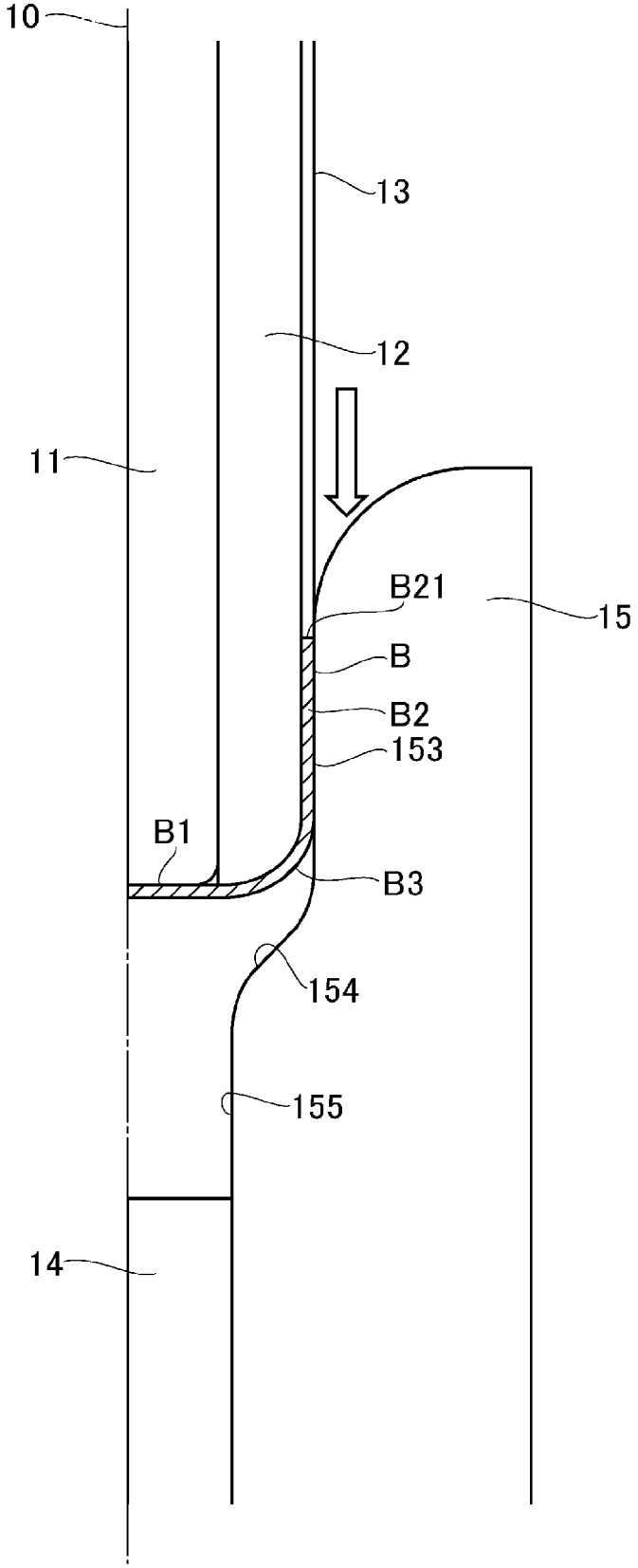
FIG. 14 is a view illustrating a step of second-stage drawing to be performed while pressing the cup opening end in the present invention.

FIG. 13 is a flowchart used for explaining a press-forming method of this embodiment, and FIG. 14 is a view used for explaining a step SA2 of drawing the first cup-shaped workpiece B.

The press-forming apparatus in this embodiment also first lowers the first and second-stage forming punches 12 and 11 integrally, to thereby form the disk-shaped workpiece A into the first cup-shaped workpiece B, similarly to the first and second embodiments (steps SA0 and SA1).

On this occasion, the press-forming apparatus, as referred in FIG. 14, in the step SA2 to be described later, does not have to lower the first and second-stage forming punches 12 and 11 down to the position close to the second die shoulder portion 154 enough to be capable of guiding the cup sidewall portion B2 to move downward by the first-stage forming punch 12 at the portion extending from the first die hole portion 153 to the second die shoulder portion 154, and may also stop the lowering at an appropriate position.

Figure 15:
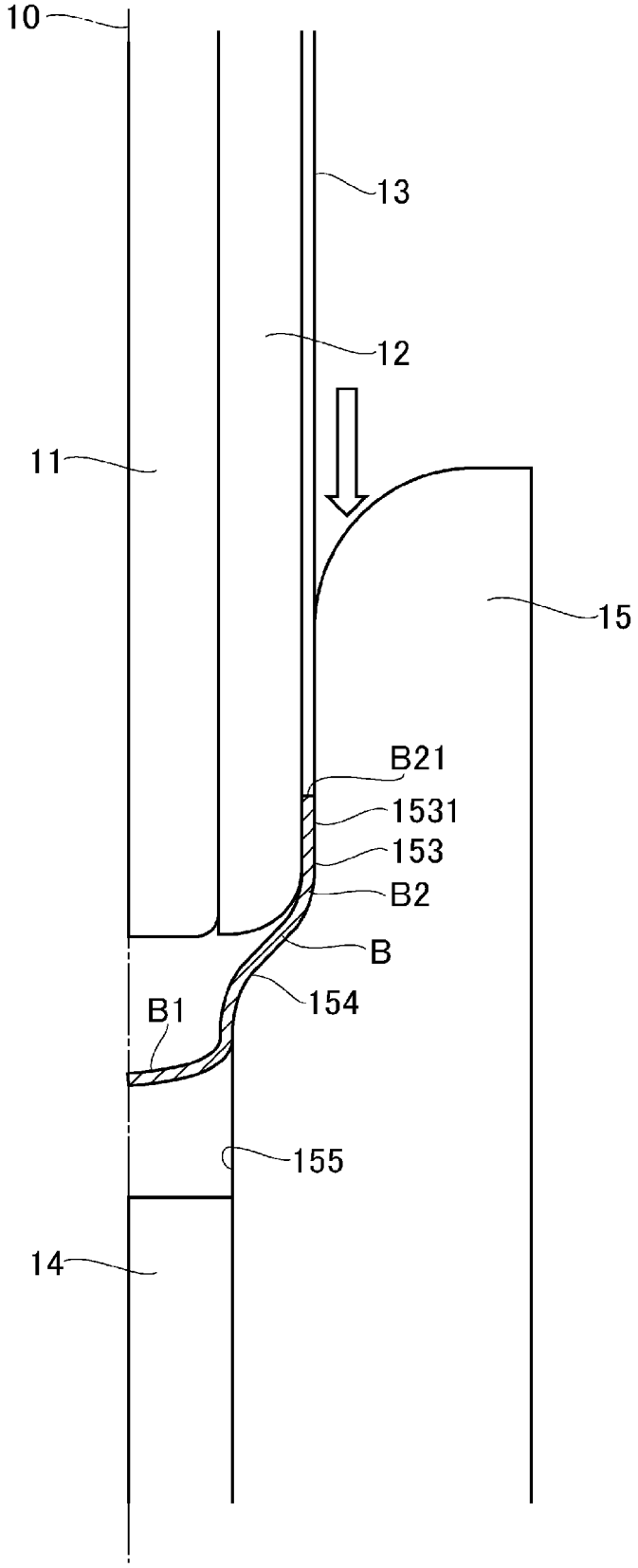
FIG. 15 is a view illustrating the step of second-stage drawing to be performed while pressing the cup opening end in the present invention.

After the steps SA0 and SA1, the press-forming apparatus lowers the axial pressing punch 13 to abut on the cup opening end B21 of the cup sidewall portion B2, and further lowers the axial pressing punch 13 while constraining the cup opening end B21. On this occasion, the press-forming apparatus lowers the first and second-stage forming punches 12 and 11 down to the portion extending from the first die hole portion 153 to the second die shoulder portion 154. Thereby, the press-forming apparatus, as illustrated in FIG. 15, pushes the first cup-shaped workpiece B into the second die hole portion 155 through the second die shoulder portion 154, to thereby reduce the cup sidewall portion B2 in diameter at the second die shoulder portion 154 to be thickened (step SA2).

On this occasion, the press-forming apparatus can suppress formed unevenness of the cup opening end B21 because the axial pressing punch 13 presses the cup opening end B21. Incidentally, in this step SA2, the press-forming apparatus stops lowering of the axial pressing punch 13 at the position where the cup opening end B21 side of the cup sidewall portion B2 is positioned between the first-stage forming punch 12 and the first die hole portion 153. This is better because in the following step SA3 of compressing the cup bottom portion B1, the cup opening end B21 side of the cup sidewall portion B2 can be constrained also in the sheet thickness direction and can be pressed more strongly. In this step SA2, the cup bottom portion B1 is curved to lose flatness.

Figure 16:
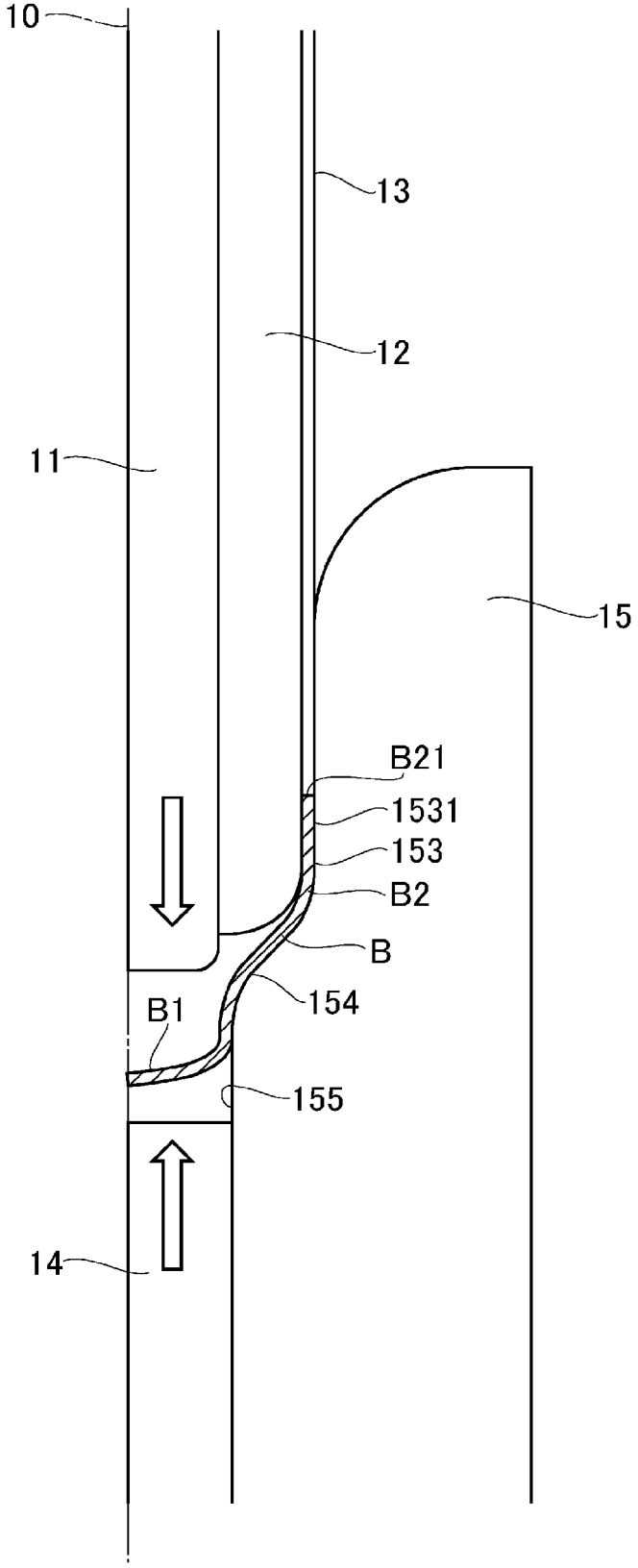
FIG. 16 is a view illustrating a step of compressing the cup bottom portion in the present invention.
Figure 17:
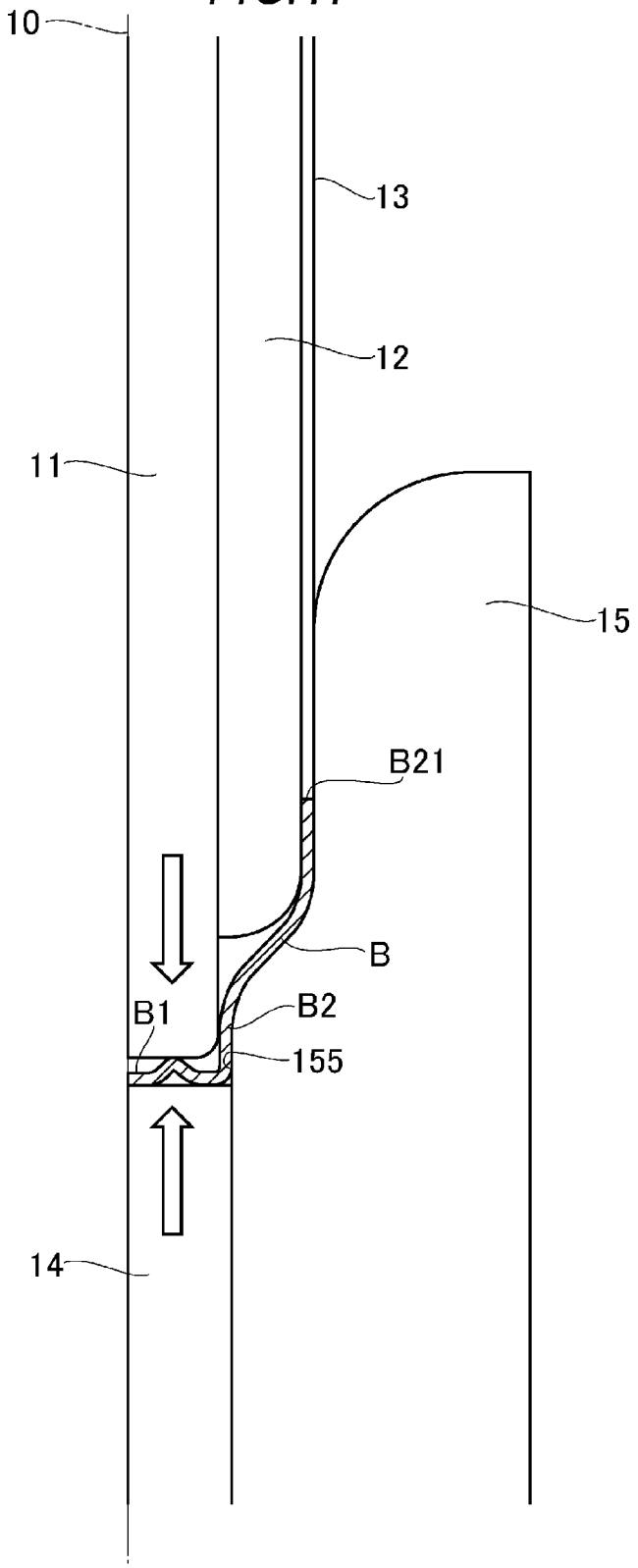
FIG. 17 is a view illustrating the step of compressing the cup bottom portion in the present invention.

Subsequently, the press-forming apparatus, as illustrated in FIG. 16, stops lowering of the axial pressing punch 13, and further lowers the second-stage forming punch 11 and raises the counter punch 14 to bring the second-stage forming punch 11 and the counter punch 14 close to each other. Then, the press-forming apparatus, as illustrated in FIG. 17, constrains the cup opening end B21 by the axial pressing punch 13 and constrains the cup bottom portion B1 side of the cup sidewall portion B2 by the second-stage forming punch 11 and the second die hole portion 155. Then, in such a constrained state, the press-forming apparatus compresses the cup bottom portion B1 in the second die hole portion 155 by the second-stage forming punch 11 and the counter punch 14.

Figure 18:
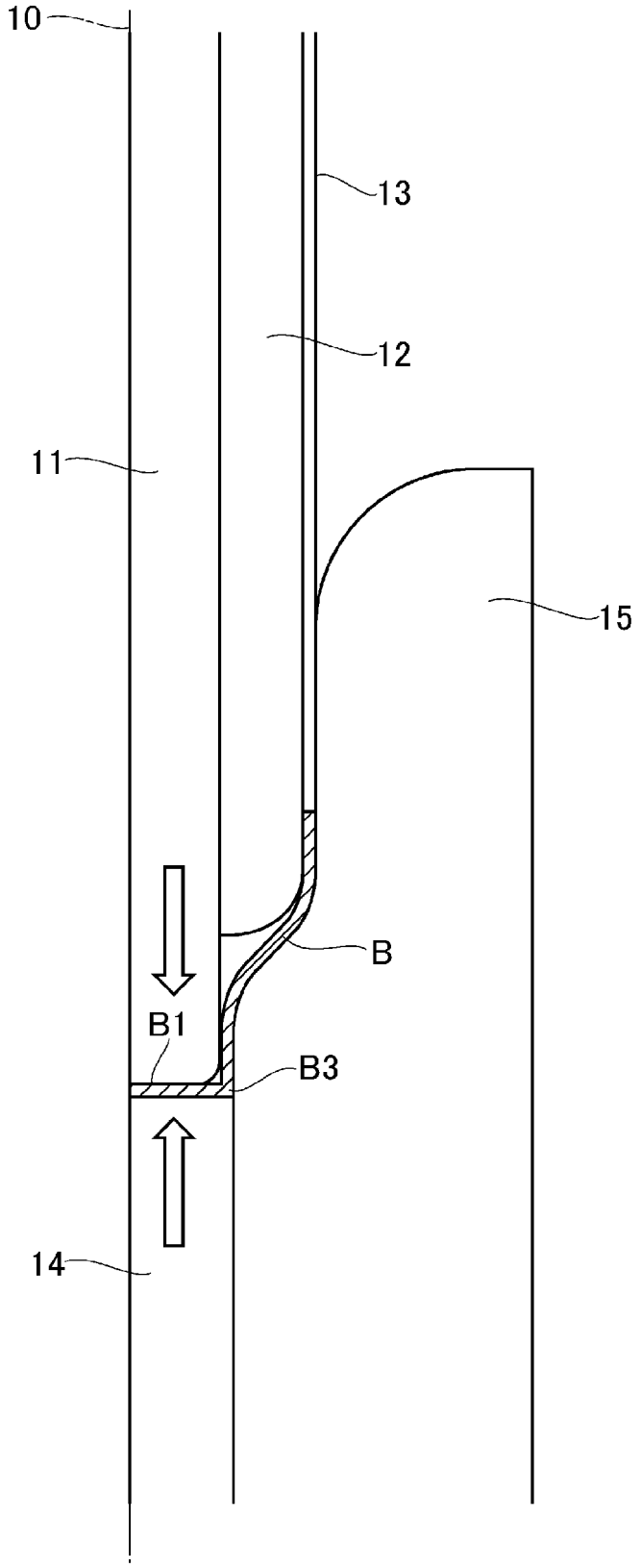
FIG. 18 is a view illustrating that a cup shoulder portion is formed into an orthogonal shape by the compression of the cup bottom portion in the present invention.

Thereby, the press-forming apparatus, as illustrated in FIG. 18, shape-corrects the cup bottom portion B1 to be flat and thickens the cup bottom portion B1. Further, the press-forming apparatus causes a redundant material derived from the cup bottom portion B1 to flow into the cup shoulder portion B3 to thicken the cup shoulder portion B3, and forms the cup shoulder portion B3 into an orthogonal shape so as to bulge outward in the radial direction of the cup bottom portion B1 (step SA3). Incidentally, in the second embodiment, the cup bottom portion B1 in the state illustrated in FIG. 6 is compressed, to thereby thicken the cup shoulder portion B3 as illustrated in FIG. 10. In this embodiment, the cup bottom portion B1 in the state illustrated in FIG. 16 that is curved more largely than in the state illustrated in FIG. 6 is compressed, to thereby thicken the cup shoulder portion B3 as illustrated in FIG. 18, so that it is possible to obtain an effect of thickening the cup shoulder portion B3 rather than the second embodiment.

Figure 19:
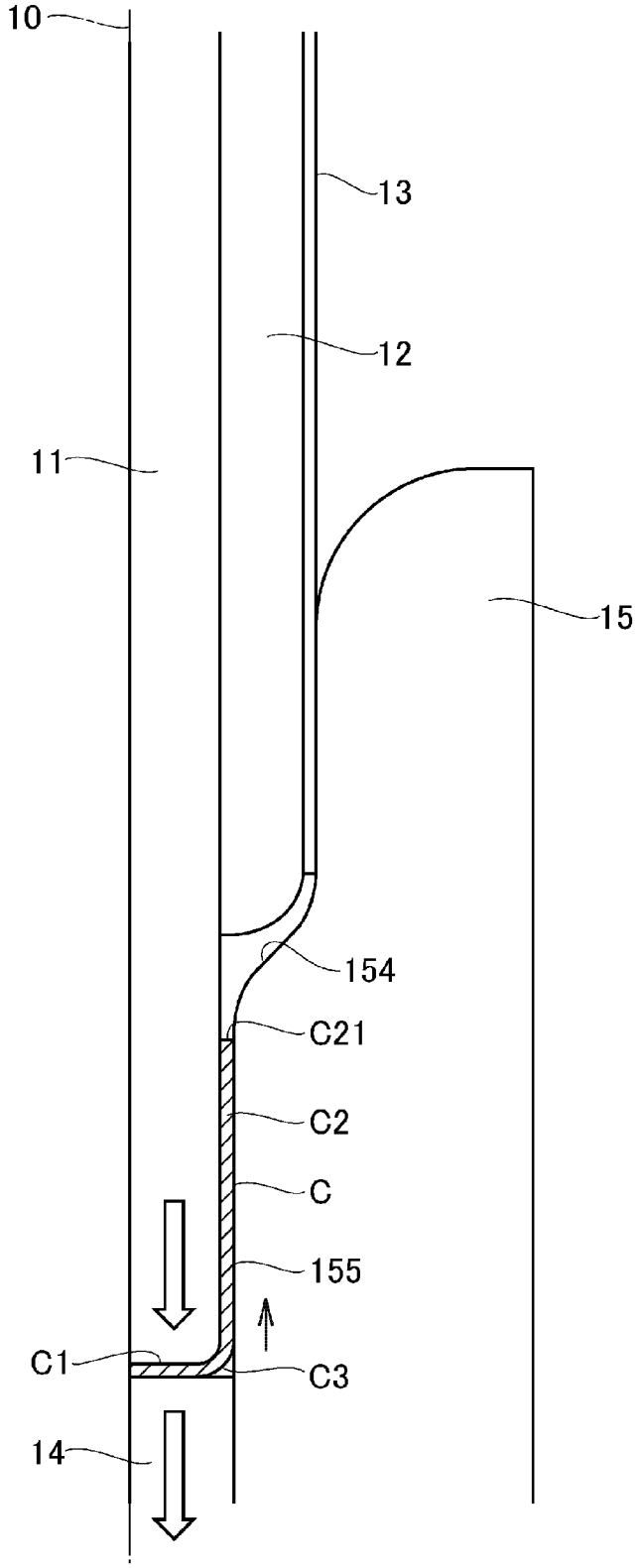
FIG. 19 is a view illustrating that the cup sidewall portion is brought to butt against the first-stage forming punch in the present invention.

Subsequently, the press-forming apparatus, as illustrated in FIG. 19, lowers the second-stage forming punch 11 and the counter punch 14 while compressing the cup bottom portion B1, to thereby complete drawing, and the second cup-shaped workpiece C is obtained (step SA4). In the step SA4, the second cup-shaped workpiece C is pushed deeper until the cup opening end C21 enters the second die hole portion 155. Further, in the step SA4, without lowering the axial pressing punch 13, the press-forming apparatus performs drawing in a state of the cup opening end B21 being released. In this case, the press-forming apparatus may also lower the axial pressing punch 13 down to the halfway position where the cup sidewall portion B2 is drawn into the second die hole portion 155, to thereby constrain the cup opening end B21.

Further, in this step SA4, when the first cup-shaped workpiece B is pushed into the second die hole portion 155, the cup sidewall portion B2 is drawn into a space between the second-stage forming punch 11 and the second die hole portion 155, and thereby a tensile load in an up and down direction is applied. The orthogonal-shaped cup shoulder portion C3 is pulled upward (see an up-arrow in FIG. 19), so that as illustrated in FIG. 19, the cup shoulder portion B3 in a state of being thickened is formed into an R shape while being in close contact with the second punch shoulder portion 113.

Figure 20:
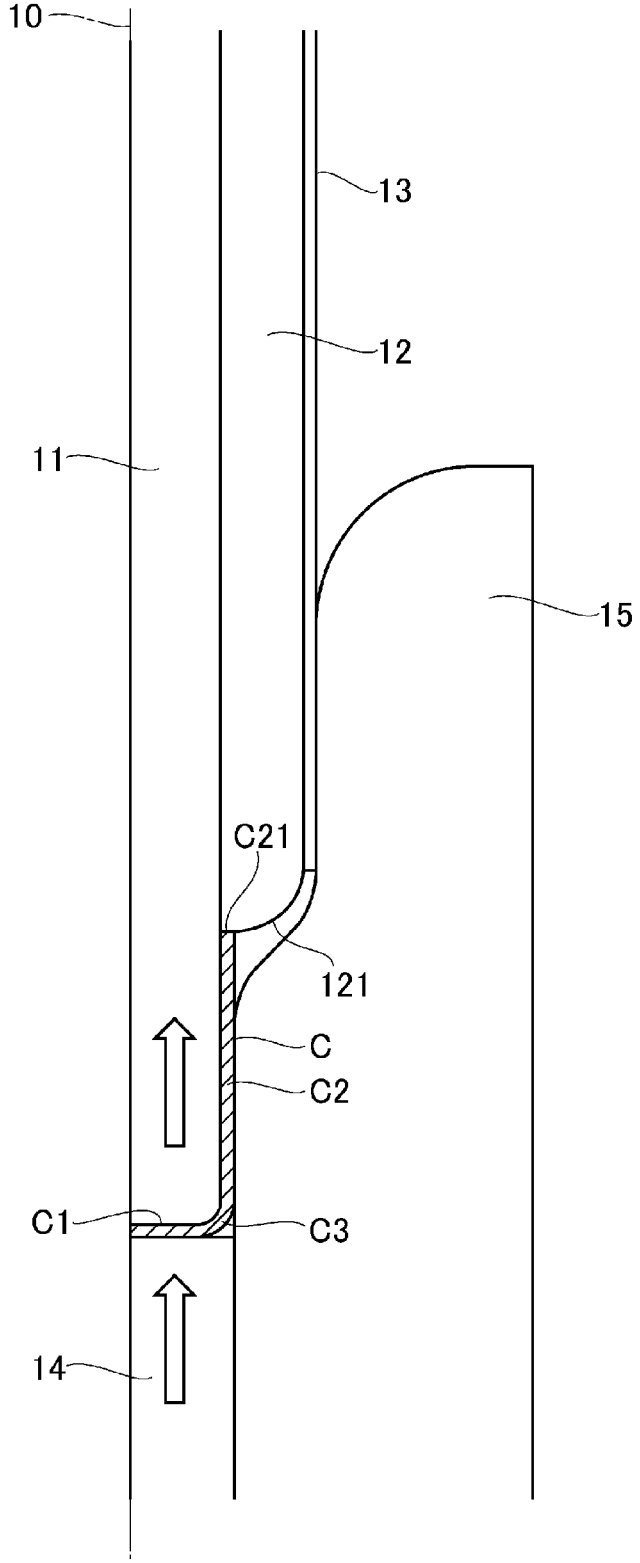
FIG. 20 is a view illustrating that the cup sidewall portion is brought to butt against the first-stage forming punch in the present invention.

The outer surface of the cup shoulder portion C3 is preferably formed into an orthogonal shape depending on application. Thus, after the step SA4 where drawing is completed, the press-forming apparatus, as illustrated in FIG. 20, raises the second-stage forming punch 11 and the counter punch 14 while compressing a cup bottom portion C1 by the second-stage forming punch 11 and the counter punch 14 and while constraining deformation of a cup sidewall portion C2 on the cup bottom portion C1 side in the sheet thickness direction by the second-stage forming punch 11 and the second die hole portion 155.

Figure 21:
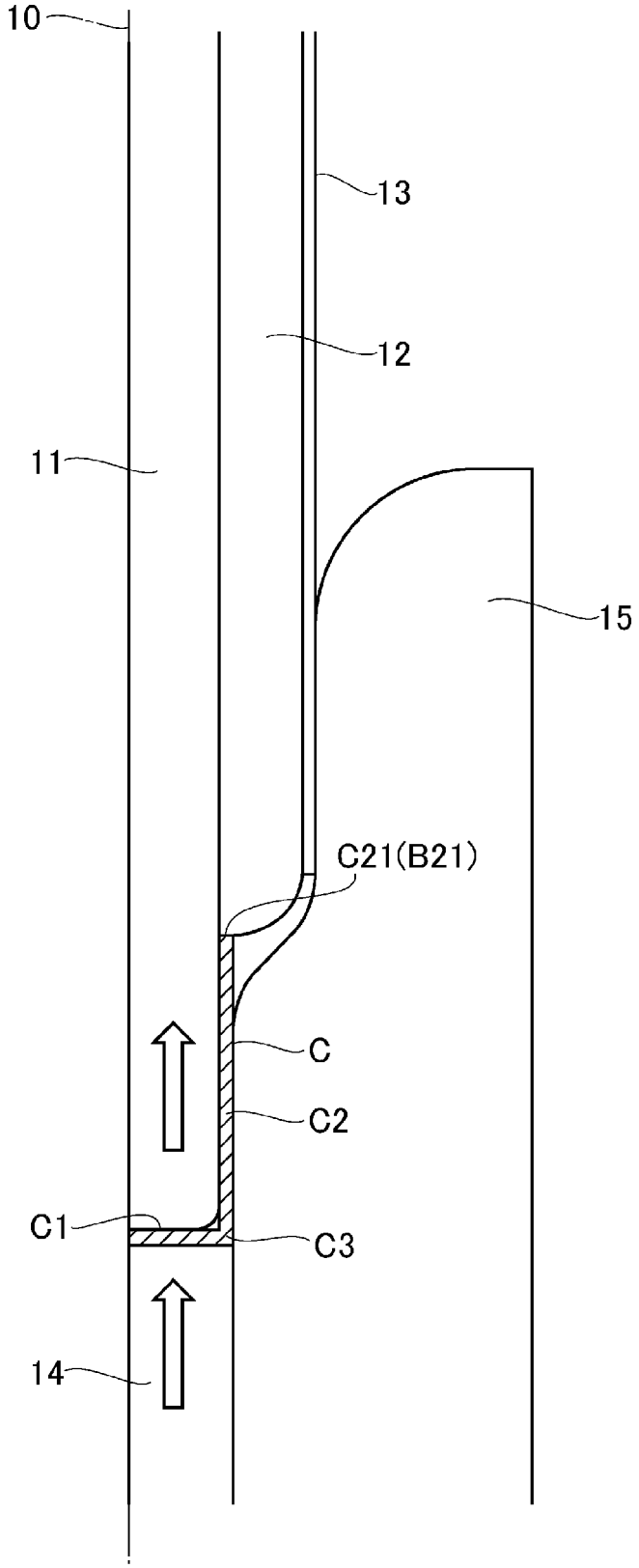
FIG. 21 is a view illustrating that the cup shoulder portion is formed into an orthogonal shape by the butting of the cup sidewall portion in the present invention.

The press-forming apparatus, as illustrated in FIG. 21, causes the cup opening end C21 to butt against the first-stage forming punch 12 and presses the cup sidewall portion C2 downward, to thereby form the cup shoulder portion C3 in close contact with the second punch shoulder portion 113 into an orthogonal shape (step SA5).

Note that in this embodiment, forming may also be completed in the step SA4 of drawing. In the case, in the step SA4, drawing may be finished at the position where the cup opening end B21 is on the second die shoulder portion 154, and the second cup-shaped workpiece C provided with the expanded opening portion C4 may also be formed (see FIG. 7).

MODIFIED EXAMPLES

In the first to third embodiments, the tools may also be disposed in the direction opposite to each other. That is, the counter punch 14 and the die 15 may also be disposed on the upper side and the first and second-stage forming punches 12 and 11 and the axial pressing punch 13 may also be disposed on the lower side.

In the respective steps of the first to third embodiments, when the operational advantage obtained by movements of certain tools of this embodiment (for example, the first and second-stage forming punches 12 and 11 and the axial pressing punch 13) can also be obtained by movement of another tool (for example the die 15) to work on the workpieces A to C in cooperation with the certain tools, in place of the movements of the certain tools of this embodiment, the side of another tool to work in cooperation with the certain tools (for example, the die 15 side) may also be moved.

For example, in the first to third embodiments, it is also possible that the press-forming apparatus raises the die 15 at the time of the first-stage drawing (steps S1 and SA1) and moves the first and second-stage forming punches 12 and 11 relatively to the die 15 to insert the first and second-stage forming punches 12 and 11 into the insertion hole portion 151, to thereby push the disk-shaped workpiece A into the insertion hole portion 151 and form the disk-shaped workpiece A into the cup-shaped workpiece B.

Further, it is also possible that at the time of the second-stage drawing in the first and second embodiments (steps S2 and S20), the press-forming apparatus raises the first-stage forming punch 12, raises the die 15 in a state of the first-stage forming punch 12 being separated from the cup bottom portion B1, and moves the second-stage forming punch 11 relatively to the die 15 to insert the second-stage forming punch 11 into the second hole portion 155, to thereby draw the first cup-shaped workpiece B. On this occasion, the press-forming apparatus raises the axial pressing punch 13 in a manner to correspond to the raise of the die 15, to thereby constrain the cup opening end B21.

Further, it is also possible that at the time of the second-stage drawing in the third embodiment as well (step SA2), the press-forming apparatus, in a state of the first and second-stage forming punches 12 and 11 being separated from the cup bottom portion B1 and in a state of the axial pressing punch 13 being kept at the same position to constrain the cup opening end B21, raises the die 15 and inserts the first cup-shaped workpiece B into the second hole portion 155, to thereby draw the first cup-shaped workpiece B.

In the first to third embodiments, it is also possible that the distance D2 in the radial direction between the inner peripheral surface 1551 of the second die hole portion 155 and the outer peripheral surface 112 of the second-stage forming punch 11 is made larger than the sheet thickness of the workpiece A and is made equal to or less than the sheet thickness on the second die shoulder portion 154 that is increased by the reduction in diameter at the time of the second-stage drawing, and thereby the cup sidewall portion C2 is thickened to have a thickness of the distance D2.

INDUSTRIAL APPLICABILITY

According to the present invention, it is possible to provide a press-forming method capable of suppressing fraction in a deformation concentrated portion even at the time of forming with a large drawing ratio, and to achieve and secure superexcellent properties in automobile parts and the like manufactured by this method.

The invention claimed is:

1. A press-forming method for a plate-shaped workpiece that uses a second-stage forming punch, a first-stage forming punch disposed along an outer periphery of the second-stage forming punch, an axial pressing punch disposed along an outer periphery of the first-stage forming punch, and a die including: from a leading end side where the first-stage and second-stage forming punches are inserted, a first die shoulder portion that expands outward as it goes to the leading end; a first die hole portion parallel to a central axis; a second die shoulder portion that faces the first-stage forming punch and the axial pressing punch in a central axis direction and expands outward as it goes to the leading end; a second die hole portion connected to the second die shoulder portion, central axes of all of which are disposed coaxially; and a counter punch disposed to face the second-stage forming punch in the central axis direction, wherein the second die hole portion is disposed along an outer periphery of the counter punch, the method comprising:

a step S1 of moving the first-stage and second-stage forming punches relatively to the die and inserting the first-stage and second-stage forming punches into the first die hole portion, to thereby push the workpiece into the first die hole portion through the first die shoulder portion to form a first cup-shaped workpiece having a cup bottom portion and a circumferential cup sidewall portion rising from a circumferential edge portion of the cup bottom portion;

a step S2 of moving the axial pressing punch relatively to the die to abut on a cup opening end of the cup sidewall portion, and while constraining the cup opening end, moving the second-stage forming punch relatively to the die to insert the second-stage forming punch into the second die hole portion and pushing a part of the first cup-shaped workpiece into the second die hole portion through the second die shoulder portion, to thereby reduce the cup sidewall portion in diameter and thicken the cup sidewall portion; wherein the step S2 includes a step S21 of, while constraining the cup opening end by the axial pressing punch and while constraining deformation of the cup sidewall portion on the cup bottom portion side in a sheet thickness direction by the second-stage forming punch and the second die hole portion, bringing the counter punch close to the second-stage forming punch to compress the cup bottom portion in the second die hole portion by the counter punch and the second-stage forming punch, to thereby form a cup shoulder portion connecting the cup bottom portion and the cup sidewall portion into an orthogonal shape and cause a material of the cup bottom portion to flow into the cup shoulder portion to thicken the cup shoulder portion; and a step S3 of, in a state of the constraint of the cup opening end by the axial pressing punch being released, moving the second-stage forming punch relatively to the die and further pushing the first cup-shaped workpiece deeper in the second die hole portion, to thereby form a second cup-shaped workpiece smaller in diameter than the first cup-shaped workpiece.

2. The press-forming method according to claim 1, wherein in the step S3, the first cup-shaped workpiece is pushed into the second die hole portion until the cup opening end is positioned on the second die shoulder portion, to thereby form the second cup-shaped workpiece provided with an expanded opening portion that expands outward as it goes to the cup opening end side.

3. A press-forming method for a plate-shaped workpiece that uses a second-stage forming punch, a first-stage forming punch disposed along an outer periphery of the second-stage forming punch, an axial pressing punch disposed along an outer periphery of the first-stage forming punch, a counter punch disposed to face the second-stage forming punch in a central axis direction, and a die including, from a leading end side where the first-stage and second-stage forming punches are inserted, a first die shoulder portion that expands outward as it goes to the leading end; a first die hole portion parallel to a central axis; a second die shoulder portion that faces the first-stage forming punch and the axial pressing punch in the central axis direction and expands outward as it goes to the leading end; and a second die hole portion disposed along an outer periphery of the counter punch, central axes of all of which are disposed coaxially, the method comprising:

a step SA1 of moving the first-stage and second-stage forming punches relatively to the die and inserting the first-stage and second-stage forming punches into the first die hole portion, to thereby push the workpiece into the first die hole portion through the first die shoulder portion to form a first cup-shaped workpiece having a cup bottom portion and a circumferential cup sidewall portion rising from a circumferential edge portion of the cup bottom portion;

a step SA2 of bringing the axial pressing punch to abut on a cup opening end of the cup sidewall portion, and while constraining the cup opening end, moving the axial pressing punch relatively to the die and pushing a part of the first cup-shaped workpiece into the second die hole portion through the second die shoulder portion, to thereby reduce the cup sidewall portion in diameter and thicken the cup sidewall portion;

a step SA3 of, while constraining the cup opening end by the axial pressing punch, bringing the second-stage forming punch and the counter punch close to each other, compressing the cup bottom portion in the second die hole portion by the second-stage forming punch and the counter punch to form the flat cup bottom portion, and causing a material of the cup bottom portion to flow into a cup shoulder portion connecting the cup bottom portion and the cup sidewall portion to thicken the cup shoulder portion; and a step SA4 of moving the second-stage forming punch relatively to the die and further pushing the first cup-shaped workpiece deeper in the second die hole portion, to thereby form a second cup-shaped workpiece smaller in diameter than the first cup-shaped workpiece.

4. The press-forming method according to claim 3, wherein in the step SA4, the second cup-shaped workpiece is pushed into the second die hole portion until the cup opening end is positioned in the second die hole portion, the method further comprising:

a step SA5 of while compressing the cup bottom portion by the second-stage forming punch and the counter punch and while constraining deformation of the cup sidewall portion on the cup bottom portion side in a sheet thickness direction by the second-stage forming punch and the second die hole portion, moving the second-stage forming punch and the counter punch relatively in a direction to come close to the first-stage forming punch to cause the cup opening end to butt against the first-stage forming punch, to thereby form the cup shoulder portion into an orthogonal shape.

5. The press-forming method according to claim 4, wherein in the step SA4, the first cup-shaped workpiece is pushed into the second die hole portion until the cup opening end is positioned on the second die shoulder portion, to thereby form the second cup-shaped workpiece provided with an expanded opening portion that expands outward as it goes to the cup opening end side.

6. The press-forming method according to claim 3, wherein in the step SA4, the first cup-shaped workpiece is pushed into the second die hole portion until the cup opening end is positioned on the second die shoulder portion, to thereby form the second cup-shaped workpiece provided with an expanded opening portion that expands outward as it goes to the cup opening end side.

* * * * *